United States Patent [19]

Kase et al.

[11] Patent Number: 5,061,615

[45] Date of Patent: Oct. 29, 1991

[54] SILVER HALIDE PHOTOGRAPHIC MATERIALS

[75] Inventors: Akira Kase; Tetsuro Kojima, both of Kanagawa, Japan

[73] Assignee: Fuji Photo Film Co., Ltd., Ashigara, Japan

[21] Appl. No.: 678,185

[22] Filed: Mar. 29, 1991

Related U.S. Application Data

[63] Continuation of Ser. No. 350,258, May 11, 1989, abandoned.

[30] Foreign Application Priority Data

May 13, 1988 [JP] Japan ..... 63-116240

[51] Int. Cl.[5] ..... G03C 1/005

[52] U.S. Cl. ..... 430/569; 430/567

[58] Field of Search ..... 430/567, 569

[56] References Cited

U.S. PATENT DOCUMENTS 4,820,624 4/1989 Hasabe et al. ..... 430/567

FOREIGN PATENT DOCUMENTS

| | | |
|---|---|---|
| 0255721A3 | 2/1988 | European Pat. Off. . |
| 0255783A2 | 2/1988 | European Pat. Off. . |
| 0273404A2 | 7/1988 | European Pat. Off. . |
| 2445541 | 7/1980 | France . |
| 62-7040 | 2/1987 | Japan . |
| 63-46441 | 2/1988 | Japan . |
| 80/00040 | 1/1980 | PCT Int'l Appl. . |

*Primary Examiner*—Charles L. Bowers, Jr.
*Assistant Examiner*—Janet C. Baxter
*Attorney, Agent, or Firm*—Burns, Doane, Swecker & Mathis

[57] ABSTRACT

Disclosed is a silver halide photographic material including a support and a photographic layer. The photographic layer includes at least one essentially silver iodide free monodisperse silver chlorobromide emulsion which is obtained using a particular bromine or bromide ion slow release agent. Also disclosed is a process for producing such a material.

26 Claims, No Drawings

SILVER HALIDE PHOTOGRAPHIC MATERIALS

This application is a continuation of application Ser. No. 07/350,258 filed May 11, 1989 now abandoned.

FIELD OF THE INVENTION

The present invention relates to silver halide photographic materials and, more particularly, to silver halide photographic materials having high speed and which maintain excellent properties from exposure through processing.

BACKGROUND OF THE INVENTION

In recent years, the time for printing process and development processing operations for print production have been shortened and speeded up, and there has been an increased demand for high speed photographic materials stability during processing, and handling durability.

The most common method for increasing the speed of a silver halide emulsion involves increasing the grain size, thereby increasing the amount of light which can be absorbed per grain. In those cases where the emulsion is color sensitive, an increase in speed can also be achieved by increasing the extent of light absorption of the sensitizing dye in such a way that photo-electrons are transmitted to the silver halide and linked to latent image formation. However, satisfactory results have not always been achieved using these methods. That is, increasing the grain size has an inhibiting effect on increasing the speed of the development process, and color sensitization not only inhibits development and de-silvering but normally reduces the remaining margin for any increase in speed with an increased amount of sensitizing dye. Hence, any method in which the speed of the silver halide grains is without increasing grain size or increasing the amount of sensitizing dye would be very useful. The method known as chemical sensitization is typical of such methods. Known such methods include those in which sulfur sensitizing agents such as sodium thiosulfate are used; those in which gold sensitizing agents such as potassium chloroauric acid are used; those in which reduction sensitizing agents such as stannous chloride are used; and methods in which combinations of these methods are used. Although the photographic speed which can be obtained using the above chemical sensitization methods is dominated by the type and quantity of sensitizing agent used, by the method of addition, and by the combination which is used, they are not the only determining factors and it is known that different results are observed depending on the nature of the silver halide grains themselves prior to chemical sensitization. For example, the way in which sulfur sensitization proceeds differs according to the habit of the silver halide crystal grains is discussed on pages 181–184 of the Journal of Photographic Science, Vol. 14 (1966) and, moreover, the efect of crystal habit on latent image formation when reduction sensitization is also carried out is discussed on pages 249–256 of volume 23 (1975) of the same journal. Furthermore, the relationships between the type of halide and the crystal habit of the halide, used for forming the emulsion grains, and the effect on photographic speed and fogging of sulfur sensitization and gold-sulfur sensitization carried out using the emulsified grains, is discussed on pages 146–149 of Photographic Science and Engineering, volume 28 (1984). However, these reports are concerned only with the effect of the nature of the silver halide grains on chemical sensitization and photographic speed. They provide no information regarding techniques and procedures for responding to the commercial demand for increased speeds and handling stability.

Methods of achieving higher speeds without increasing the silver halide grain size have been proposed for silver halide photographic materials. Furthermore, a further increase in handling strength and processing stability can be anticipated by increasing the photographic speed.

The formation of silver halide grains using so-called "halogen conversion" is proposed in JP-B-50-36978 and is one method for increasing the photographic speed of a silver halide. (The term "JP-B as used herein signifies an "examined Japanese patent publication".) The silver halide emulsions obtained using this method are seen to have an increased photographic speed and they have a further advantage in that the extent of fogging due to mechanical pressure is reduced. However, the inventors have discovered that these emulsions also have serious defects. That is, even though, the level of fogging is produced by mechanic pressure is reduced, there is a pronounced desensitization when parts which have been subjected to a mechanical pressure are exposed to light. The extent of halogen conversion can be reduced to minimize the extent of pressure desensitization, but this increases fogging due to pressure. Thus there are problems with fogging and desensitization due to pressure, and the two are incompatible. Furthermore, silver halide converted emulsions of this type have also been found to have softer gradation.

SUMMARY OF THE INVENTION

Acordingly, an object of the invention is to overcome the problems described above and to provide stable silver halide emulsions which have hard contrast and high speed. In other words, an object of the invention is to provide silver halide photographic materials which contain silver halide grains which, when chemically sensitized, can provide high speed which is uniform from grain to grain.

The aforementioned object of the invention has been attained by means of a silver halide photographic material containing a support having thereon a light-sensitive layer comprising at least a substantially silver iodide-free monodisperse silver chlorobromide emulsion having the variation coefficient of not more than 0.25 obtained by adding a bromine or bromide ion slow release agent, and then conducting halogen conversion after forming the silver halide grains by reacting a water soluble silver salt and a water soluble halide, followed by sulfur sensitization, said release agent being represented by formula (S):

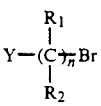

(S)

wherein Y represents an organic group having a Hammett $\sigma_p$ value greater than O, $R_1$, and $R_2$, which may be identical or different, are selected from hydrogen, alkyl groups, alkenyl groups, aralkyl groups, aryl groups, or other organic groups, Y and $R_1$ may undergo ring closure to form a heterocyclic ring, said other organic groups having Hammett $\sigma_p$ values greater than 0, and n is an integer of from 1 to 3.

Preferably, the above objects can be attained by means of silver halide photographic material having a photographic layer which contains at least one essentially silver iodide-free monodisperse silver chlorobromide emulsion obtained by adding compounds which are represented by the general formulae (I), (II) or (III) described below to a silver halide emulsion which contains at least 95 mol % of silver chloride, which has an average grain size of 0.2 to 2 μm and a monodisperse grain size distribution, adsorbing these compounds on the (100) planes of the silver halide grains, adding a bromine or bromide ion slow release agent in an amount ranging from 0.1 mol % to 5 mol % based on the total silver halide content, carrying out halogen conversion before sulfur sensitization, and then carrying out sulfur sensitization.

DETAILED DESCRIPTION OF THE PREFERRED EMBODIMENTS

The halogen conversion used in the present invention differs from that which occurs when a water soluble bromide is added to the silver halide grains (see e.g., JP-A-62-7040). That is, the rate of supply of the bromine or bromide ion from the slow release agent is slower and halogen conversion proceeds uniformly from grain to grain. (The term "JP-A" as used herein signifies an "unexamined published Japanese patent application".)

There have been proposed methods in which fine silver bromide grains are mixed with the silver halide grains and physical ripening is then carried out (see e.g., JP-A-63-46441) as a means of overcoming the difficulties described above. The present invention differs from such methods in that the need for the separate preparation of fine silver bromide grains is eliminated so that emulsion preparation can be achieved quickly and easily. Also it is possible to obtain emulsions which have harder contrast and higher speed since the halogen conversion takes place uniformly from grain to grain.

As noted above, in formula (S) Y represents a group in which the Hammett $\sigma_p$ value is greater than zero. Hammett $\sigma_p$ values have been defined on page 96 of "Structure/Activity Correlations for Drugs", published by Nankodo (1979), and substituent groups can be selected on the basis of this table. Preferred groups for Y include halogen atoms such as bromine, chlorine or fluorine, trifluoromethyl groups, cyano groups formyl groups, carboxylic acid groups, sulfonic acid groups, carbamoyl groups such as unsubstituted carbamoyl or diethylcarbamoyl groups, acyl groups such as acetyl or benzoyl groups, oxycarbonyl groups such as methoxycarbonyl or ethoxycarbonyl groups, sulfonyl groups such as methanesulfonyl or benzenesulfonyl groups, sulfonyloxy groups such as methanesulfonyloxy groups, carbonyloxy groups such as acetoxy groups, sulfamoyl groups such as unsubstituted sulfamoyl or dimethylsulfamoyl groups, and heterocyclic groups such as 2-thienyl, 2-benzoxazolyl, 2-benzothiazolyl, 1-methyl-2-benzimidazolyl, 1-tetrazolyl, 2-quinolyl groups.

$R_1$ and $R_2$ may be hydrogen atoms, substituted or unsubstituted alkyl groups such as methyl, ethyl, n-propyl or hydroxyethyl groups, alkenyl groups such as vinyl or allyl groups, aralkyl groups such as benzyl groups, or aryl groups such as phenyl or p-tolyl groups, or those groups represented by Y described above.

As noted above, Y and $R_1$ may undergo ring closure and form a heterocyclic group such as an imidazolyl, pyridyl, thienyl, quinolyl or tetrazolyl ring.

In general formula (S), Y is preferably a cyano group, a carboxylic acid group, a carbamoyl group, an acyl group, a sulfonyl group, an oxycarbonyl group, a sulfamoyl group or a heterocyclic group, $R_1$ and $R_2$ are preferably hydrogen atoms or selected from those groups represented by Y. The value n is preferably an integer of value 1 or 2.

Specific examples of compounds represented by general formula (S) are set forth below, but the invention is not limited to these examples.

$BrCH_2COOH$ (S-1)

$Br(CH_2)_2COOH$ (S-2)

$Br(CH_2)_3COOH$ (S-3)

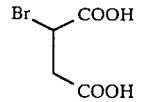
(S-4)

$BrCH_2CN$(S-5)

$Br(CH_2)_2CONH_2$ (S-6)

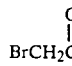
(S-8)

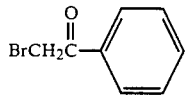
(S-7)

$Br(CH_2)_2SO_2CH_3$ (S-9)

$BrCHCH_2SO_2CH_3$ (S-10)

$CH_3$ $BrCH_2COOCH_3$ (S-11)

$BrCH_2CH_2SO_2NH_3$ (S-12)

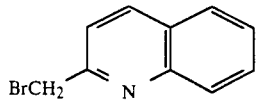
(S-13)

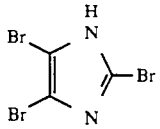
(S-14)

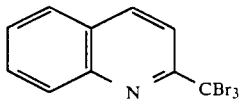
(S-15)

$BrCH_2CH_2SO_3Na$ (S-16)

The bromine or bromide ion slow release agents are added at a rate within the range from 0.1 to 5 mol % with respect to the total amount of silver halide. They are preferably added at a rate within the range from 0.2 to 3 mol % with respect to the total amount of silver halide.

Prior to the addition of the slow release agent, the silver halide grains are preferably cubic or tetradecahedral crystalline grains which may have the corners rounded off and have high order planes, and the halide composition is that of a silver chlorobromide or silver chloride which contains less than 2 mol % of, and preferably no, silver iodide. The silver halide preferably includes silver halide crystals which contain at least 80 mol % of silver chloride having at least 5 mol % of silver chloride, and most prferably contains a silver halide which includes at least 99 mol % silver chloride, or pure silver chloride crystals. The average grain size of the silver halide is preferably from 0.2 to 2 μm, and the preferred grain size distribution is a monodispersion.

The term "monodisperse emulsion" as used herein means an emulsion which has a grain size distribution such that the variation coefficient ($S/\bar{r}$) for the size of the silver halide grains is not more than 0.25. Here, $\bar{r}$ is the average grain size and S is the standard deviation of the grain size. That is, if the grain size of an individual emulsion grain is $r_i$ and the number of grains is $\bar{r}_i$, the average grain size $\bar{r}$ is defined as follows:

$$r = \frac{\Sigma ni \cdot ri}{\Sigma ni}$$

Furthermore, the standard deviation is defined as follows:

$$S = \sqrt{\frac{\Sigma(r - ri)^2 \cdot ni}{\Sigma ni}}$$

"Size of an individual grain" as used herein means the projected area corresponding diameter corresponding to the area projected in a microphoto (usually obtained with an electron microscope) of the silver halide emulsion using the methods well known in the industry and described by T. H. James et al. in "The Theory of the Photographic Process", Third Edition, pages 36–43, published by Macmillan in 1966. Here, the projected area corresponding diameter of a silver halide grain is defined as the diameter of a circle of area equal to that of the projected area of the silver halide grain as described in the textbook referred to above. Hence, the values of the average grain size $\bar{r}$ and the standard deviation S can be obtained in the way described above even in cases where the form of the silver halide grains is other than spherical (e.g., when the grains have a cubic, octahedral, tetradecahedral, tabular or potato-like form).

The variation coefficient with respect to the grain size of the silver halide grains is preferably not more than 0.20, more preferably not more than 0.15, and most preferably not more than 0.10.

However, in the case of mixtures of the above-mentioned monodisperse emulsions, and polydisperse emulsions, or in cases in which two or more monodisperse emulsions which have different average grain sizes are mixed together, the variation coefficient of the mixed emulsion may be greater than 0.25.

In the present invention, the adsorption of a compound as described below on the (100) plane of the afore-mentioned silver halide grains is preferred for controlling the initiation point for halogen conversion.

Thus, cyanine dyes, merocyanine dyes, mercaptoazoles (actual examples include the compounds represented by the general formulae (XXI), (XXII) and (XXIII) described in detail hereinafter) nucleic acids and nucleic acid degradation products such as deoxyribonucleic acid degradation products formed during the degradation of ribonucleic acid, adenine, guanine, uracil, cytosine and thymine may be used, but the compounds represented by the general formulae (I), (II) or (III) indicated below are especially desirable.

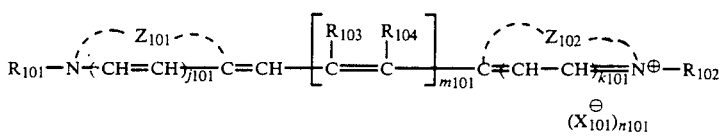

(I)

In formula II), $Z_{101}$ and $Z_{102}$ each represents a group of atoms suitable for forming a heterocyclic nucleus.

The heterocyclic nuclei are preferably five or six membered rings which contain both nitrogen atoms and sulfur atoms, oxygen atoms, selenium atoms or tellurium atoms as hetero atoms. The rings may be condensed with other rings and they may also have substituent groups.

Actual examples of the aforementioned heterocyclic nuclei include the thiazole nucleus, benzothiazole nucleus, naphthothiazole nucleus, selenazole nucleus, benzoselenazole nucleus, naphthoselenazole nucleus, oxazole nucleus, benzoxable nucleus, naphthoxazole nucleus, imidazole nucleus, benzimidazole nucleus, naphthimidazole nucleus, 4-quinoline nucleus, pyrroline nucleus, pyridine nucleus, tetrazole nucleus, indolenine nucleus, benzindolenine nucleus, indole nucleus, tellurazole nucleus, benzotellurazole nucleus and the naphthotellurazole nucleus.

$R_{101}$ and $R_{102}$ each represents an alkyl group, an alkenyl group, an alkynyl group or an aralkyl group. These groups and the groups described below are used here in the sense that they may contain substituent groups. For example, when alkyl groups are used, they may be unsubstituted or substituted alkyl groups, and they may have a straight chain, branched chain or cyclic form. The preferred alkyl groups have from 1 to 8 carbon atoms.

Furthermore, actual examples of substituent groups for such substituted alkyl groups include halogen atoms such as chlorine, bromine, or fluorine, cyano groups, alkoxy groups, substituted and unsubstituted amino groups, carboxylic acid groups, sulfonic acid groups and hydroxyl groups. Also, the alkyl groups may be substituted with one or more of these groups.

A specific example of such an alkenyl group is the vinylmethyl group.

Specific examples of aralkyl groups include the benzyl group and the phenethyl group.

The value $m_{101}$ represents 0 or 1, 2 or 3. When $m_{101}$ is 1 then $R_{103}$ represents a hydrogen atom, a lower alkyl group, an aralkyl group or an aryl group.

Specific examples of aryl groups include substituted and unsubstituted phenyl groups.

$R_{104}$ represents a hydrogen atom. In cases where $m_{101}$ has a value of 2 or 3, $R_{103}$ represents a hydrogen atom and $R_{104}$ represents a hydrogen atom, a lower alkyl group or an aralkyl group, or it may be joined to $R_{102}$ to form a 5- or 6-membered ring. Furthermore, in cases where $m_{101}$ represents 2 or 3 and $R_{104}$ represents a hydrogen atom, $R_{103}$ may be joined to another $R_{103}$ to form a hydrocarbon ring or a heterocyclic ring. These rings are preferably 5- or 6-membered rings. The values $j_{101}$ and $k_{101}$ each represents 0 or 1, $X^{\ominus}_{101}$ represents an acid anion, and $n_{101}$ represents 0 or 1.

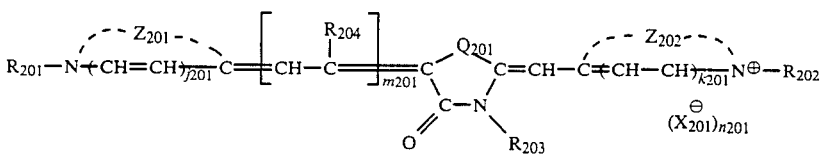

(II)

In formula (II), $Z_{201}$ and $Z_{202}$ have the same significance as $Z_{101}$ and $Z_{102}$ described with respect to formula (I). Likewise, $R_{201}$ and $R_{202}$ have the same significance as $R_{101}$ or $R_{102}$. $R_{203}$ represents an alkyl group, an alkenyl group, an alkynyl group or an aryl group such as a substituted or unsubstituted phenyl groups. Moreover, $m_{201}$ represents 0, 1 or 2. $R_{204}$ represents a hydrogen atom, a lower alkyl group or an aryl group, and when $m_{201}$ represents 2, $R_{204}$ represents a hydrogen atom, a lower alkyl group or an aryl group. When $m_{201}$ represents 2, the $R_{204}$ groups may also be joined together to form a hydrocarbon ring or a heterocyclic ring. These are preferably 5 - or 6-membered rings.

$Q_{201}$ represents a sulfur atom, an oxygen atom, a selenium atom or an $>N—R_{205}$ group, where $R_{205}$ has the same significance as $R_{203}$. Moreover, $j_{201}$, $k_{201}$, $X^{\ominus}_{201}$ and $n_{201}$ have the same significance as $j_{101}$, $k_{101}$, $X^{\ominus}_{101}$ and $n_{101}$, respectively.

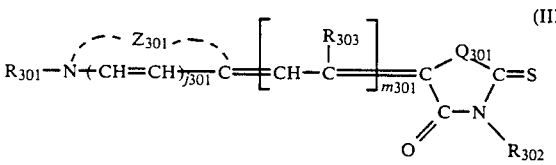

(III)

In this formula, $Z_{301}$ represents a group of atoms which form a heterocyclic ring. The heterocyclic ring may be the same as those described in connection with $Z_{101}$ and $Z_{102}$ or a ring such as, for example, a thiazolidine nucleus, thiazoline nucleus, benzothiazoline nucleus, naphthothiazoline nucleus, selenazolidine nucleus, selenazoline nucleus, benzoselenazoline nucleus, naphthoselenazoline nucleus, benzoxazoline nucleus, naphthoxazoline nucleus, dihydropyridine nucleus, dihydroquinoline nucleus, benzimidazoline nucleus or a naphthimidazoline nucleus. $Q_{301}$ has the same significance as $Q_{201}$. $R_{301}$ has the same significance as $R_{101}$ or $R_{102}$, and $R_{302}$ has the same significance as $R_{203}$. Moreover, $m_{301}$ has the same Significance as $m_{201}$. $R_{303}$ has the same significance as $R_{204}$. When $m_{301}$ represents 2 or 3, one $R_{303}$ group may be linked to another $R_{303}$ group to form a hydrocarbon ring or a heterocyclic ring. The value $j_{301}$ has the same significance as $j_{101}$.

Emulsions prepared using the method of manufacture of this invention provide concentrated latent image or development centers and can provide very high photographic speeds, markedly improved stability, and do not lack rapid development properties. With these emulsions fogging is suppressed and they provide excellent stability. Rather surprisingly, it is also possible to obtain high contrast emulsions and there are further advantages in that, since the emulsions have excellent pressure characteristics, pressure desensitization is slight and there is little fogging in the unexposed parts.

One of the features of the present invention is that the adsorbing compounds used can be selected from among the sensitizing dyes. Compounds which are useful in respect of the (100) plane in particular can be selected from among the compounds represented by the aforementioned general formulae (I), (II) and (III). Since these can function as sensitizing dyes there is a further advantage in that there is increased spectral sensitization.

Moreover, other sensitizing dyes may be included in order to provide higher speeds and for increased stabilization, and super-sensitizing agents can also be used.

For example, the substituted aminostilbene dye compounds, with nitrogen containing heterocyclic nuclei, such as the compounds of general formula (I) and more especially, illustrative compounds (I-1) to (I-17) disclosed in the specification of JP-A 62-174738, and those disclosed in U.S. Pat. Nos. 2,933,390 and 3,635,721, the aromatic organic acid/formaldehyde condensates such as those disclosed in U.S. Pat. No. 3,743,510, cadmium salts and azaindene compounds may be included. The combinations disclosed in U.S. Pat. Nos. 3,615,613, 3,615,641, 3,617,295 and 3,635,721 are particularly useful.

Specific examples of adsorbing compounds which are represented by general formulae (I), (II) and (III) are indicated below, but the invention is not limited to these examples.

CR-1

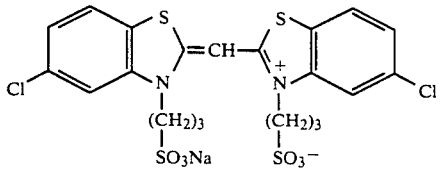

-continued
CR-2
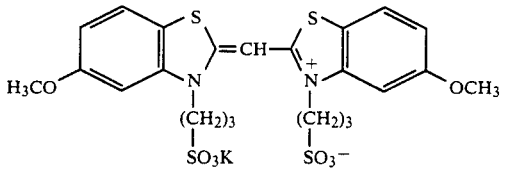
CR-3
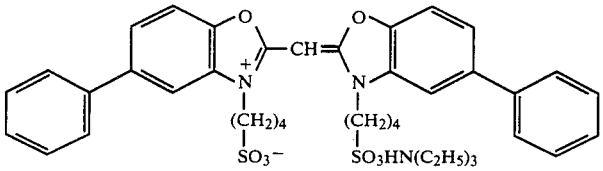
CR-4
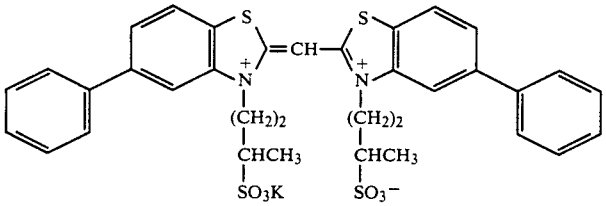
CR-5
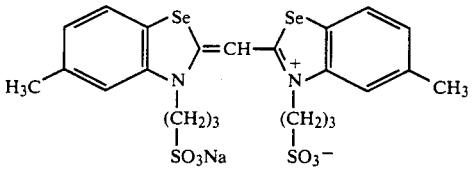
CR-6
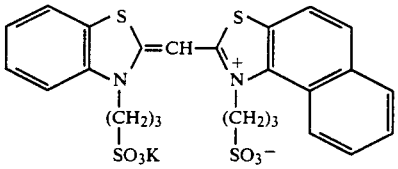
CR-7
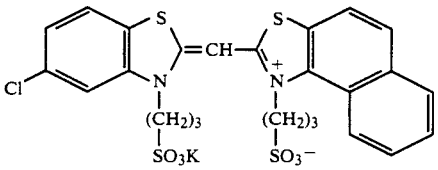
CR-8
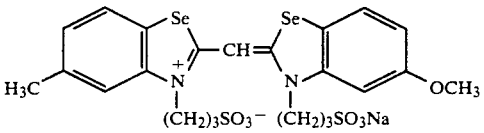
CR-9
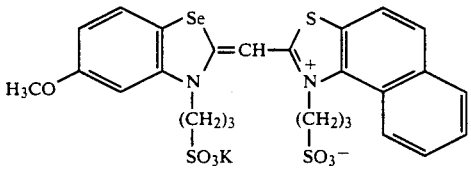

-continued
CR-10
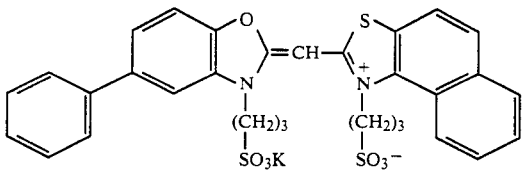
CR-11
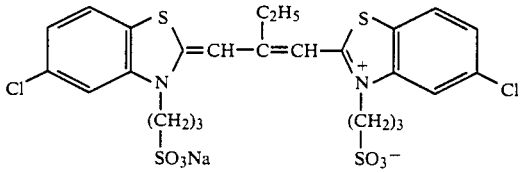
CR-12
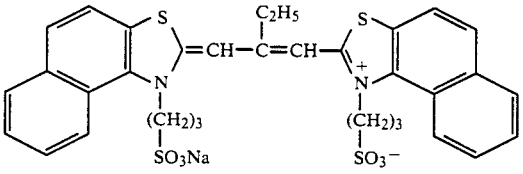
CR-13
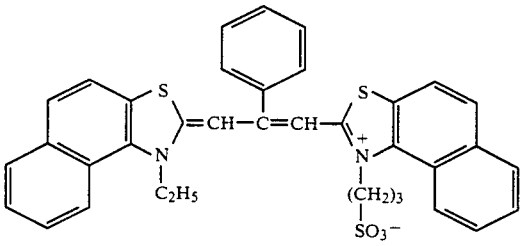
CR-14
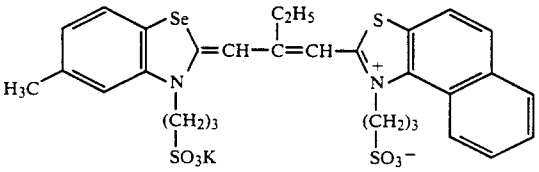
CR-15
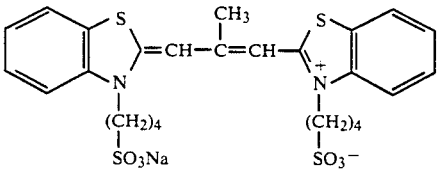
CR-16
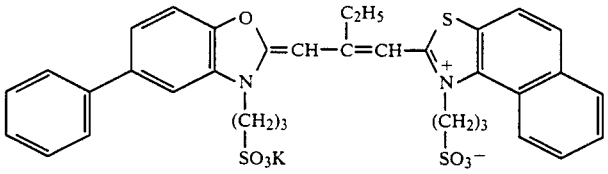
CR-17
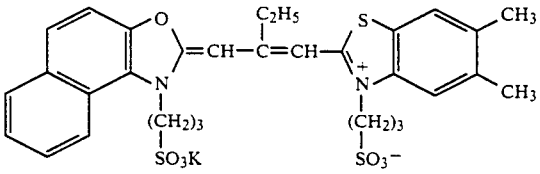

-continued
CR-18
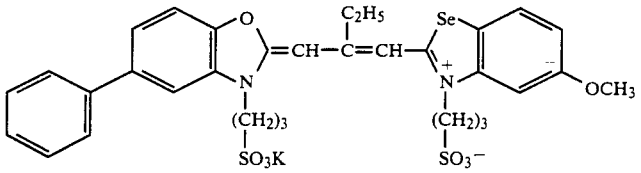
CR-19
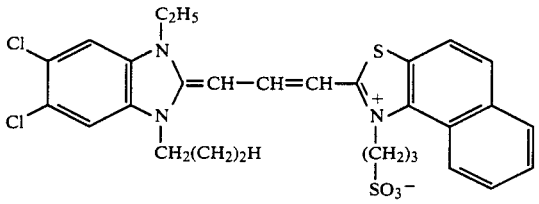
CR-20
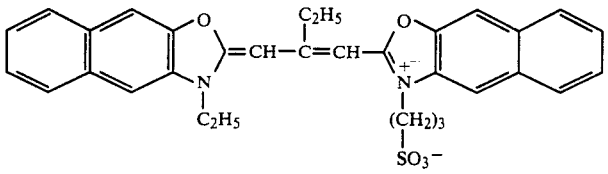
CR-21
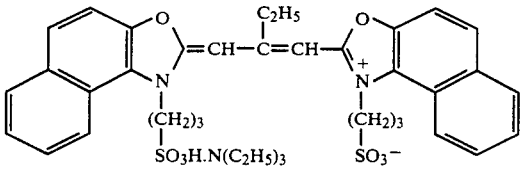
CR-22
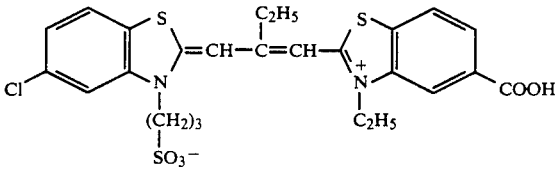
CR-23
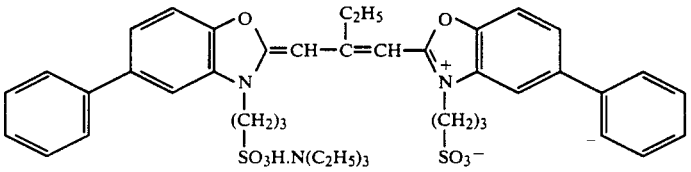
CR-24
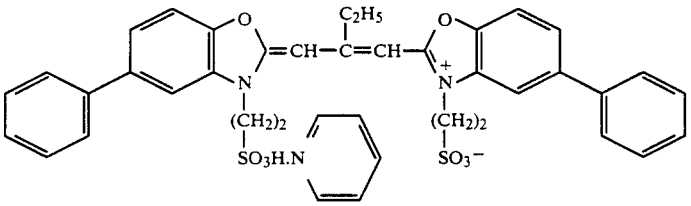
CR-25
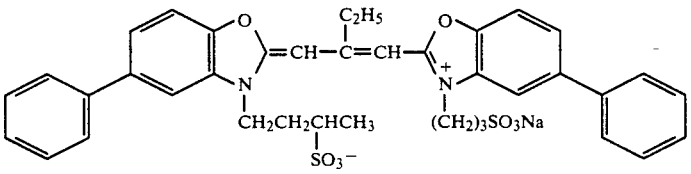

-continued
CR-26
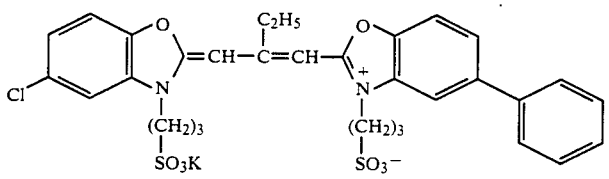
CR-27
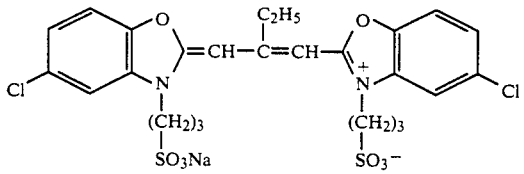
CR-28
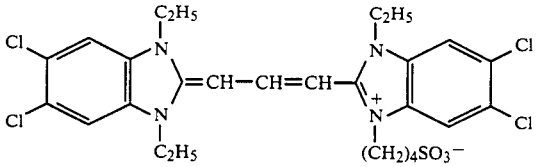
CR-29
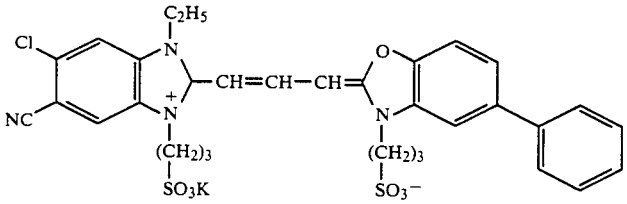
CR-30
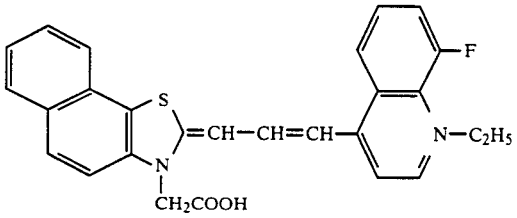
CR-31
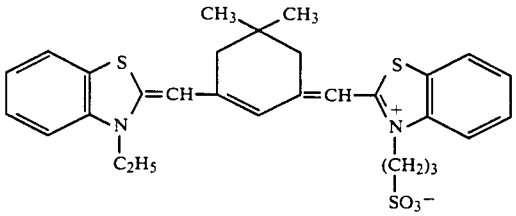
CR-32
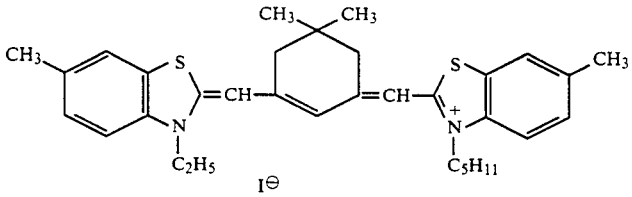
CR-33
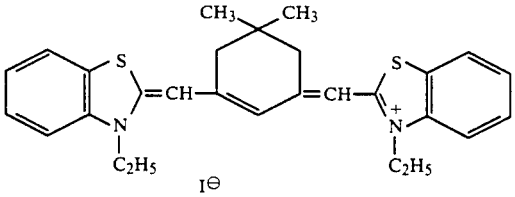

-continued
CR-34
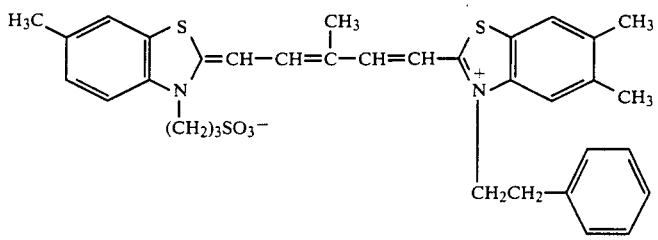
CR-35
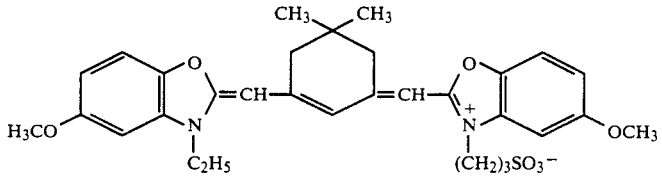
CR-36
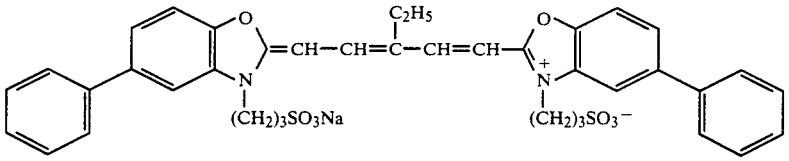
CR-37
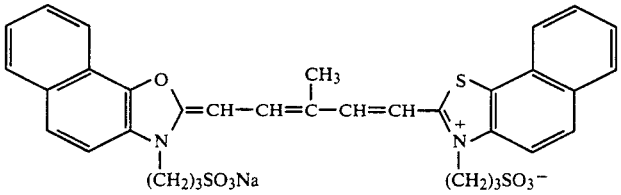
CR-38
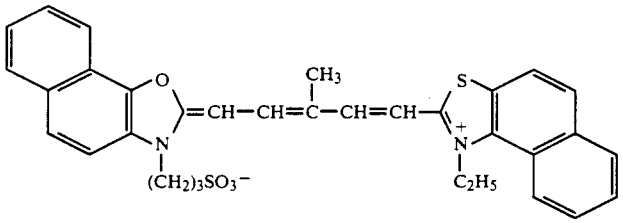
CR-39
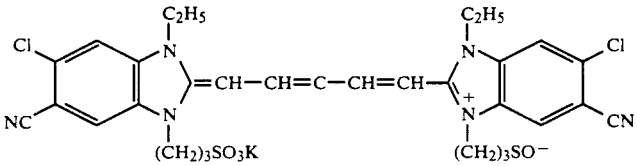
CR-40
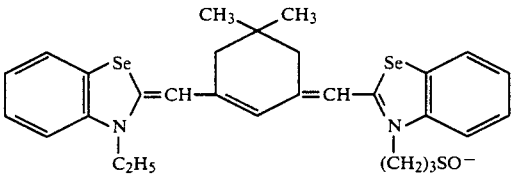
CR-41
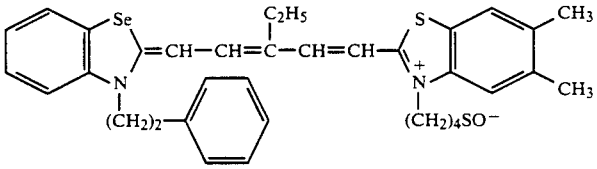

-continued
CR-42
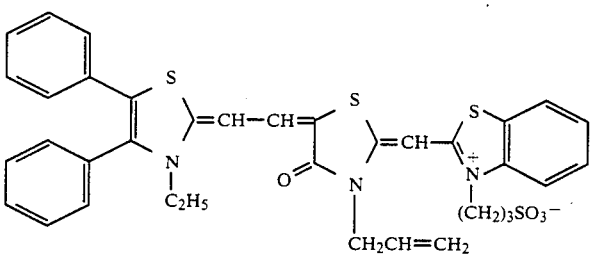
CR-43
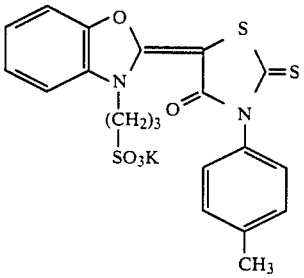
CR-44
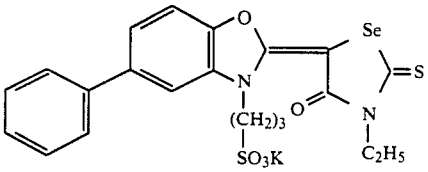
CR-45
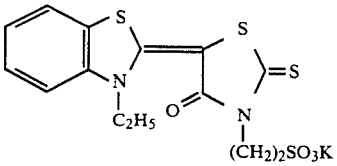
CR-46
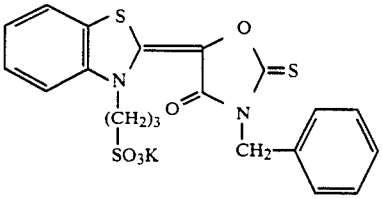
CR-47
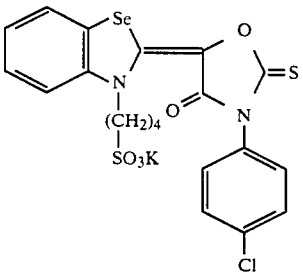
CR-48
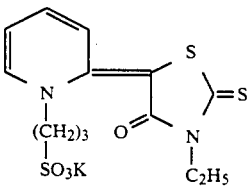

-continued
CR-49
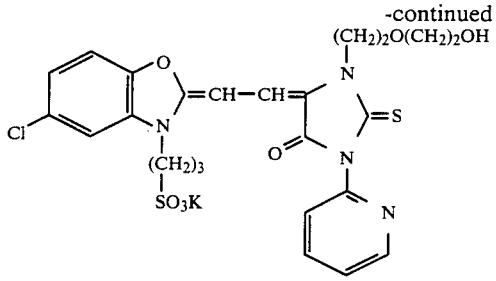
CR-50
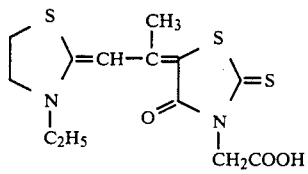
CR-51
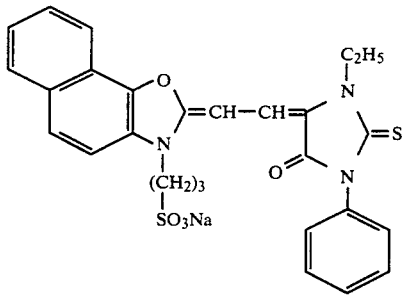
CR-52
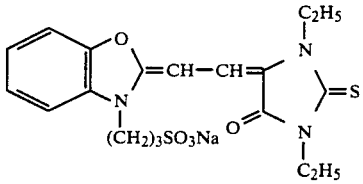
CR-53
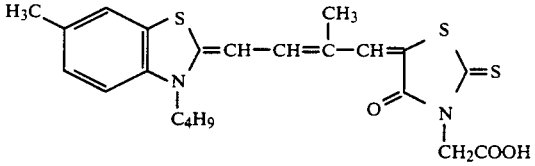
CR-54
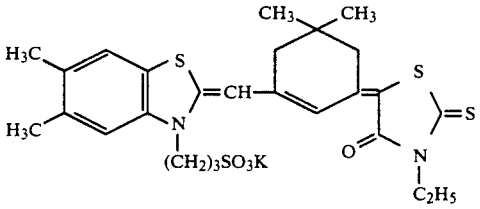
CR-55
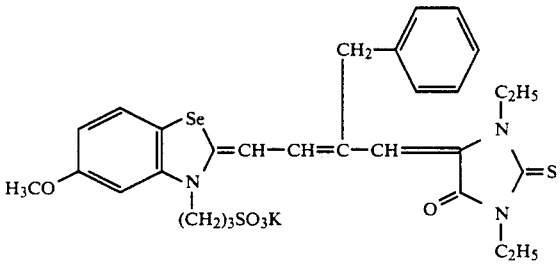
The silver halide emulsions used in this invention can be prepared using a process in which the pH and the In those cases where the aforementioned adsorbing compounds are added, they may be added to the silver halide emulsion in the form of a solution in a water miscible organic solvent such as ethyl acetate or an alcohol such as methanol. Furthermore, the adsorbing compounds may be added in the form of a dispersion in an aqueous gelatin solution or an aqueous surfactant solution. The amount added is preferably from $10^{-6}$ to $10^{-2}$ mol, and most desirably from $10^{-5}$ to $10^{-3}$ mol, per mol of silver halide. A bromine or bromide ion slow release agent as described earlier is then added and halogen conversion is carried out while suitably controlling the temperature within the range of from 30° to 80° C. and the silver ion concentration within the range from pAg 5 to pAg 10.

Sensitizing dyes are then added, supersensitizing agents are added, and spectral sensitization is carried out, as required.

The silver halide emulsion is subjected to sulfur sensitization after completion of halogen conversion with the bromine or bromide ion slow release agent.

Anti-fogging agents such as mercaptotriazoles, mercaptotetrazoles and benzotriazoles can be used in the silver halide emulsions.

The use of silver chlorobromide emulsions which have a high silver chloride content is preferred for rapid development processing, and stabilizers or anti-fogging agents which are strongly adsorbed on silver halides, such as mercapto-compounds, nitrobenzotriazole compounds and benzotriazole compounds, can be used. Development accelerators, anti-halation agents, anti-irradiation agents and fluorescent whiteners, etc., can also be used.

The use of stabilizing agents such as those represented by the general formulae (XXI), (XXII) and (XXIII) is particularly preferred in this invention.

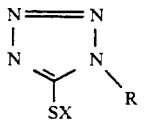

(XXI)

In formula (XXI), R represents an alkyl group, an alkenyl group or an aryl group. X represents a hydrogen atom, an alkali metal atom, an ammonium group or a precursor thereof. The alkali metal atom is, for example, a sodium atom or a potassium atom, and the ammonium group is, for example, a tetramethylammonium group or a trimethylbenzylammonium group. Furthermore, precursors include groups which can form X=H or alkali metal under alkaline conditions being, for example, acetyl groups, cyanoethyl groups or a methanesulfonylethyl groups.

The alkyl and alkenyl groups among the aforementioned R groups may or may not be substituted groups, and they may also take the form of alicyclic groups. Examples of substituent groups for the substituted alkyl groups include halogen atoms, nitro groups, cyano groups, hydroxyl groups, alkoxy groups, aryl groups, acylamino groups, alkoxycarbonylamino groups, ureido groups, amino groups, heterocyclic groups, acyl groups, sulfamoyl groups, sulfonamido groups, thioureido groups, carbamoyl groups, alkylthio groups, arylthio groups, heterocyclic thio groups, and carboxylic acid groups, sulfonic acid groups and salts thereof.

The aforementioned ureido groups, thioureido groups, sulfamoyl groups, carbamoyl groups, and amino groups include unsubstituted groups, N-alkyl substituted groups and N-aryl substituted groups. Phenyl group and substituted phenyl groups are examples of aryl groups. They may be substituted with alkyl groups or the substituent groups indicated above for the alkyl groups.

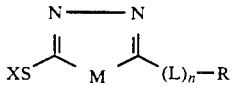

(XXII)

In formula (XXII), M represents a sulfur atom or an oxygen atom, L represents a divalent linking group and R represents a hydrogen atom, an alkyl group, an alkenyl group or an aryl group. The alkyl groups and alkenyl groups for R, and X, have the same significance as in general formula (XXI).

Specific examples of the aforementioned divalent linking groups which can be represented by L include

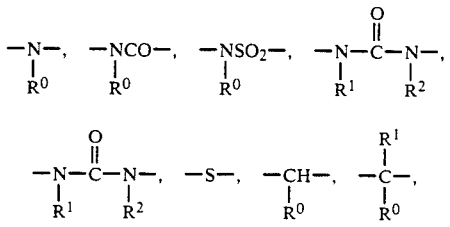

and combinations thereof.

The value, n is 0 or 1, and $R^0$, $R^1$ and $R^2$ each represents a hydrogen atom, an alkyl group or an aralkyl group.

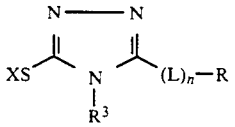

(XXIII)

In formula (XXIII), R and X have the same significance as those in general formula (XXI), and L has the same significance as that in general formula (XXII). $R^3$ has the same significance as R, and the R and $R^3$ may be the same or different.

Compounds which are represented by general formulae (XXI), (XXII) or (XXIII), can be incorporated in any layer in a silver halide color photographic material and/or in the color development bath. In this regard "any layer in a silver halide color photographic material" signifies any photosensitive or nonphotosensitive hydrophilic colloid layer.

The amount of the compounds represented by general formulae (XXI), (XXII) and (XXIII) which may be added are preferably from $1\times10^{-5}$ to $5\times10^{-2}$ mol, and most preferably from $1\times10^{-4}$ to $1\times10^{-2}$ mol, per mol of silver halide. Furthermore, when they are included in a color development bath they are preferably included in an amount of from $1\times10^{-6}$ to $1\times10^{-3}$ mol/liter, and most preferably from $5\times10^{-6}$ to $5\times10^{-4}$ mol/liter.

Specific examples of compounds which are represented by the general formulae (XXI), (XXII) and (XXIII) are indicated below, but such compounds are not limited to these examples. The compounds disclosed in JP-A-62-269957 can also be included here.

[XXI]-(1)

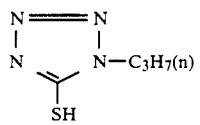

(2)

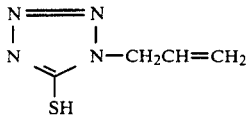

(3)

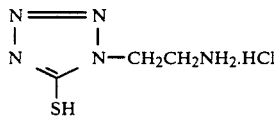

(4)

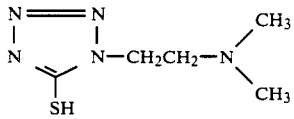

(5)

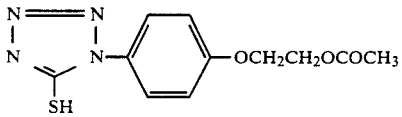

(6)

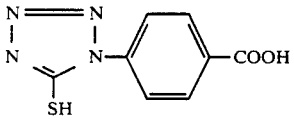

(7)

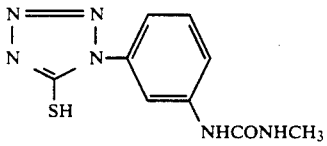

(8)

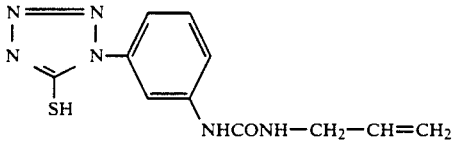

[XXII]-(1)

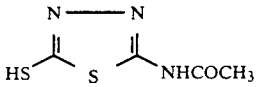

(2)

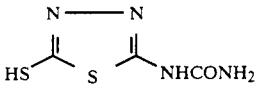

(3)

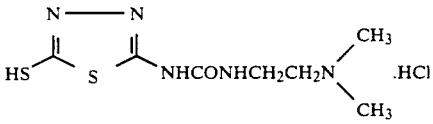

(4)

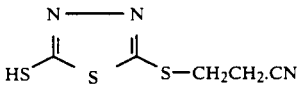

-continued (5)

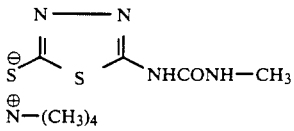

[XXIII]-(1)

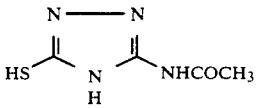

(2)

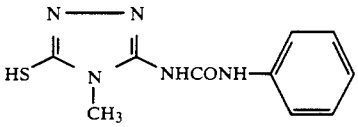

Color couplers can be used in the invention and examples are described below. As well as satifying the general requirements in connection with the hue of the color which is formed and the extinction coefficient, these couplers must also be highly active so that the coupling reaction with the oxidized form of the color developing agent, for example, a p-phenylenediamine derivative, does not become rate determining since the development of the silver halides of this invention proceeds very quickly. In this regard, the use of those couplers represented by general formulae (IV), (V), (VI), (VII) and (VIII) below is preferred.

(IV)

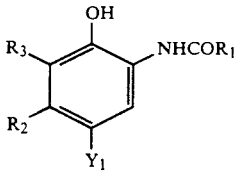

(V)

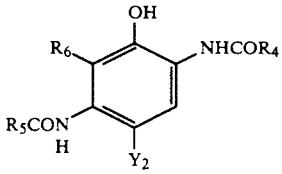

(VI)

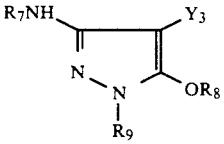

(VII)

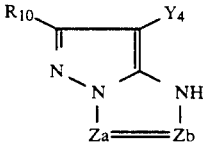

(VIII)

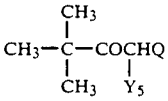

In the above formulae, $R_1$, $R_4$ and $R_5$ each represents an aliphatic group, an aromatic group, a heterocyclic group, an aromatic amino group or a heterocyclic amino group, $R_2$ represents an aliphatic group, $R_3$ and $R_6$ each represents a hydrogen atom, a halogen atom, an aliphatic group, an aliphatic oxy group or an acylamino group, $R_7$ and $R_9$ represent substituted or unsubstituted phenyl groups, $R_8$ represents a hydrogen atom, an aliphatic or aromatic acyl group, or an aliphatic or aromatic sulfonyl group, $R_{10}$ represents a hydrogen atom or a substituent group, Q represents a substituted or unsubstituted N-phenylcarbamoyl group, Za and Zb represent methine groups, substituted methine groups or =N— groups, $Y_1$, $Y_2$ and $Y_4$ represent halogen atoms or groups (referred to hereinafter as "coupling off" groups) which can be eliminated during a coupling reaction with the oxidized form of a developing agent, $Y_3$ represents a hydrogen atom or a coupling-off group, and $Y_5$ represents a coupling-off group. In general formulae (IV) and (V), $R_2$ and $R_3$, and $R_5$ and $R_6$, may form 5-, 6- or 7-membered rings.

Moreover, oligomers consisting of dimers or larger units can be formed via $R_1$, $R_2$, $R_3$ or $Y_1$; $R_4$, $R_5$, $R_6$ or $Y_2$; $R_7$, $R_8$, $R_9$ or $Y_3$: $R_{10}$, Za, Zb or $Y_4$; or Q or $Y_5$.

$R_1$, $R_2$, $R_3$, $R_4$, $R_5$, $R_6$, $R_7$, $R_8$, $R_9$, $R_{10}$, Za, Zb, $Q_1$, $Y_1$, $Y_2$, $Y_3$ and $Y_4$ in the aforementioned general formulae (IV), (V), (VI), (VII) and (VIII) are the same as those of general formulae (I), (II), (III), (IV), and (V) disclosed from the lower right column on page 4 to the upper left column on page 11 of the specification of JP-A-63-11939.

Specific examples of these couplers include (C-1) to (C-40), (M-1) to (M-42), and (Y-1) to (Y-46) disclosed on pages 1 to 24 of the specification of JP-A-63-11939, but some of the preferred compounds are indicated below.

C-(1)

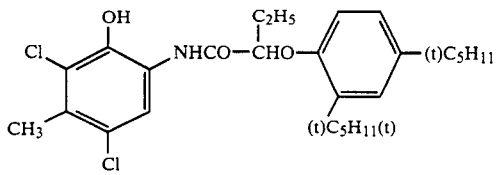

(2)

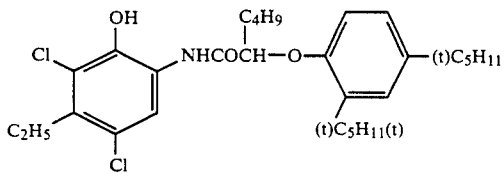

(3)

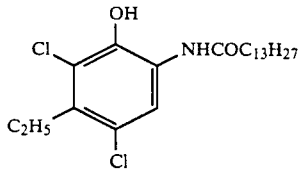

(4)

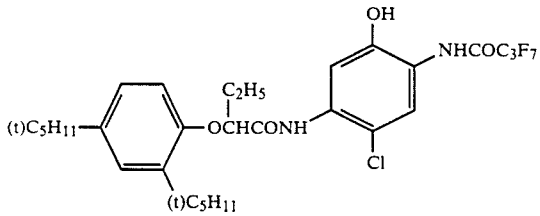

(5)

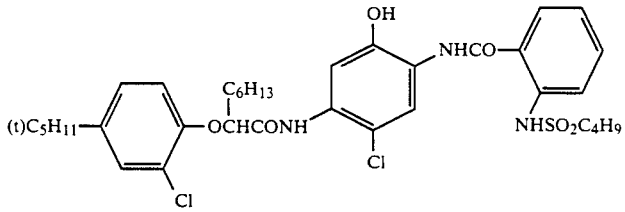

-continued
(6)
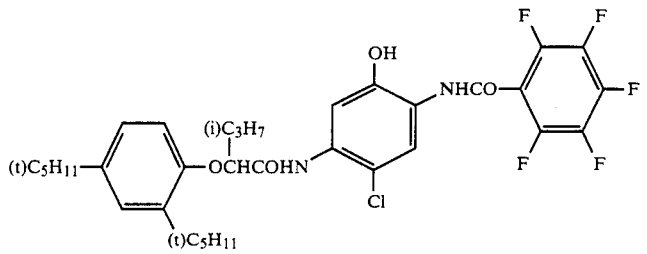
(7)
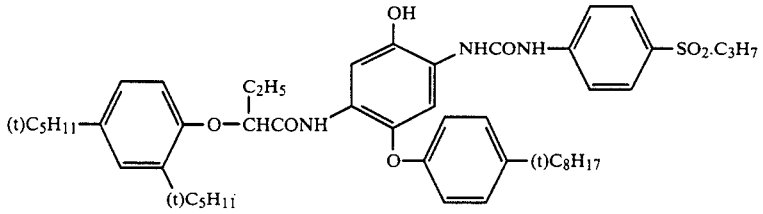
(8)
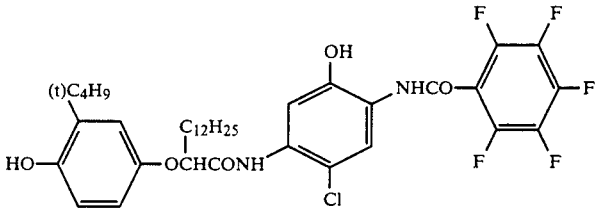
(9)
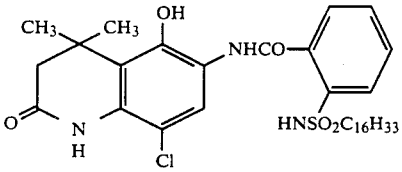
(10)
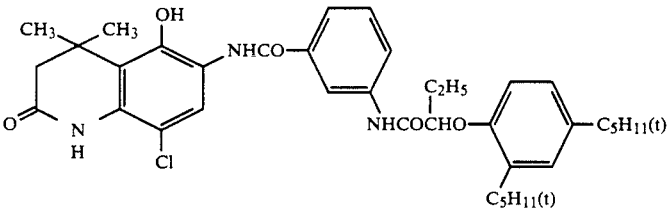
(11)
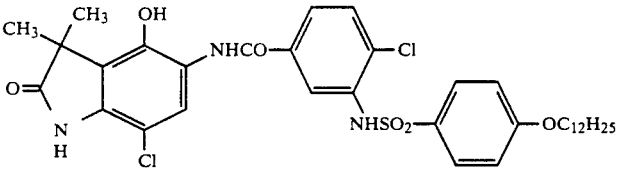
(12)
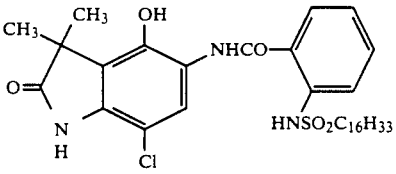

-continued
(13)
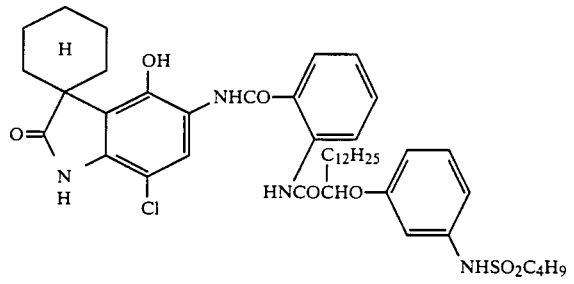
(14)
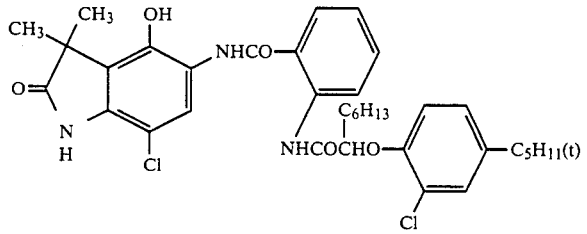
(15)
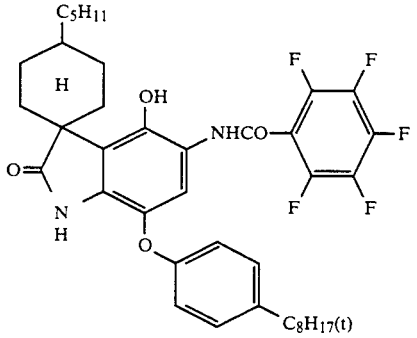
(16)
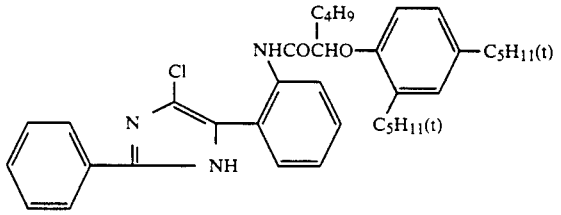
(17)
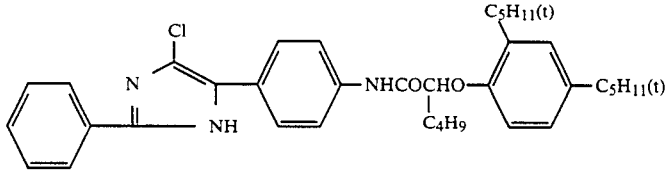
(18)
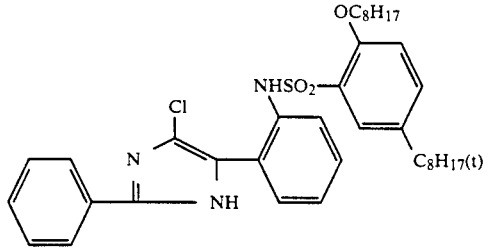

-continued
(19)
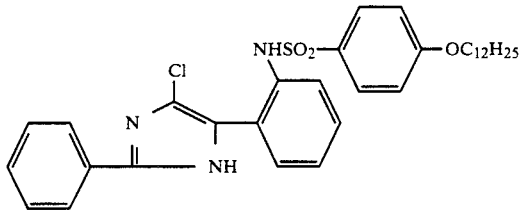
(20)
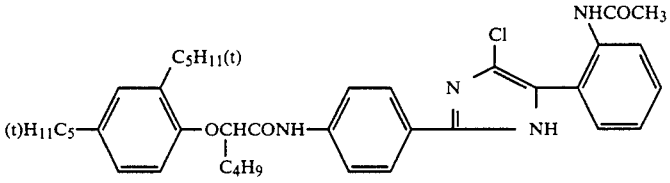
(21)
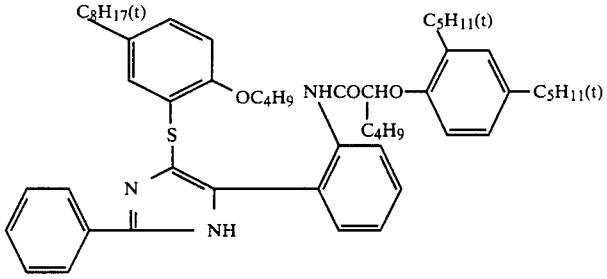
M-(1)
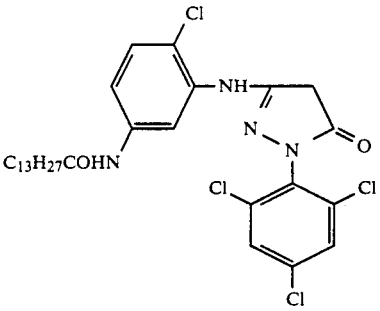
(2)
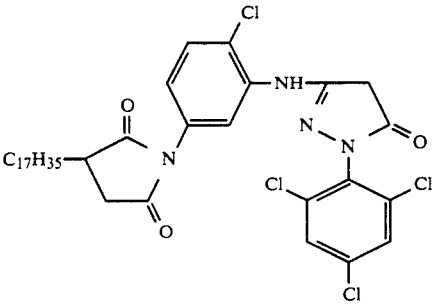
(3)
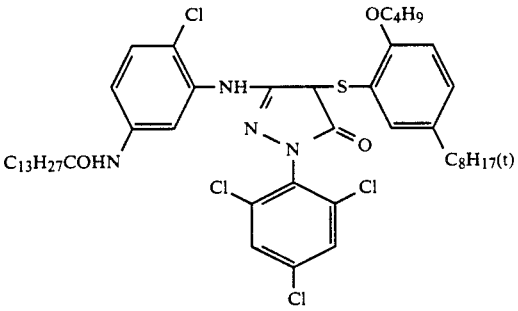

-continued
(4)
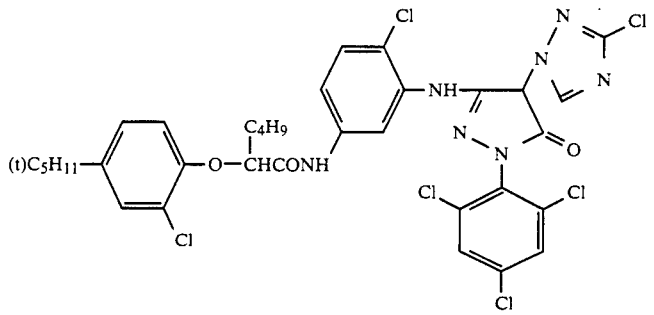
(5)
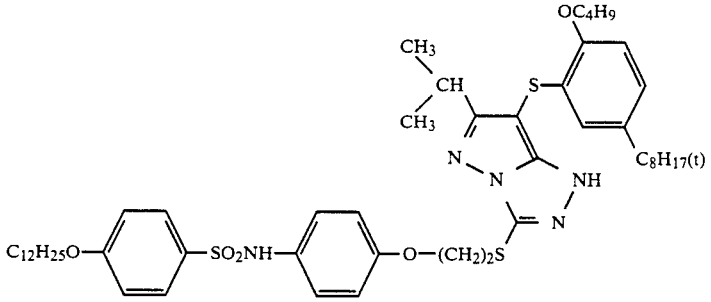
(6)
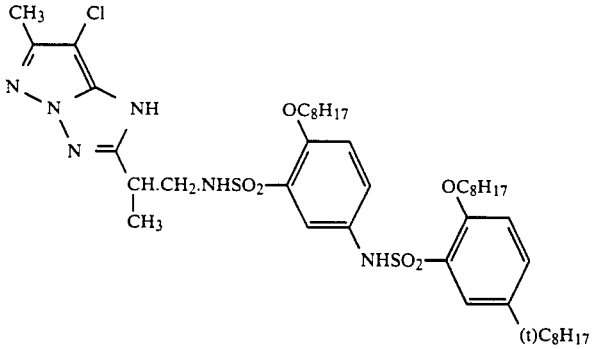
(7)
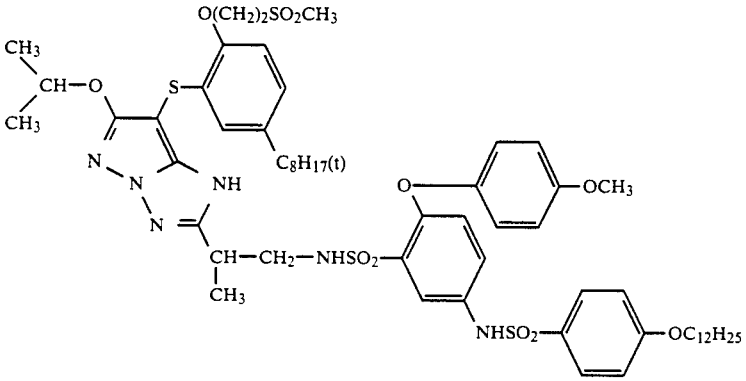
(8)
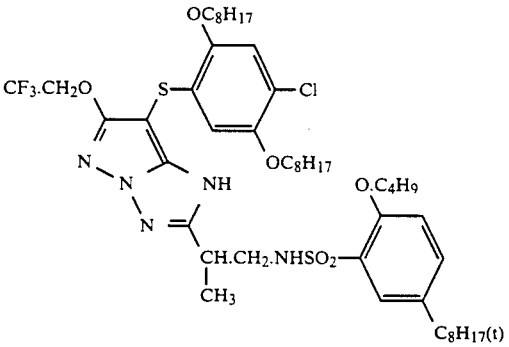

-continued
(9)
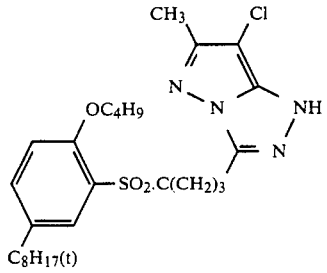
(10)
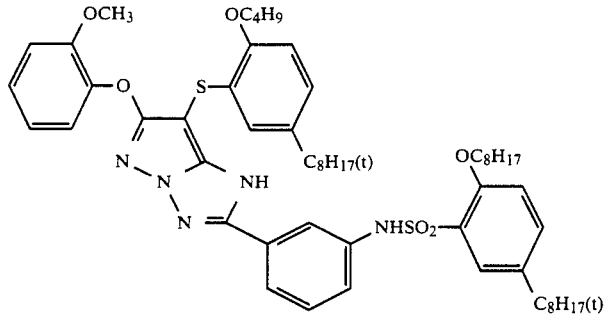
(11)
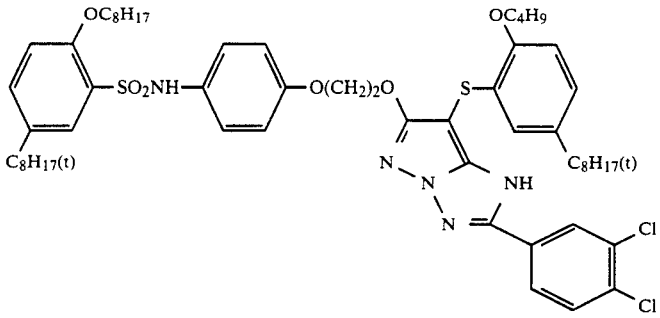
(12)
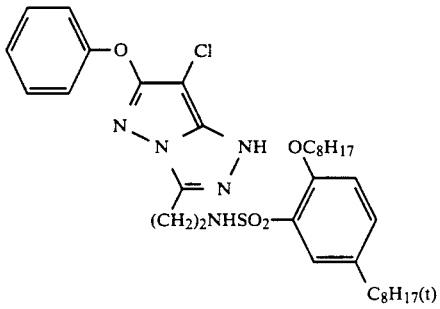
(13)
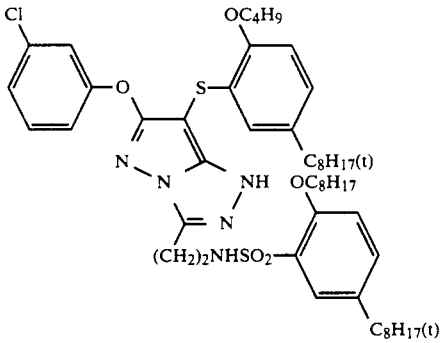

-continued

Y-(1)

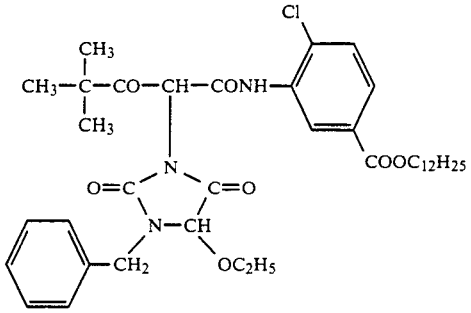

(2)

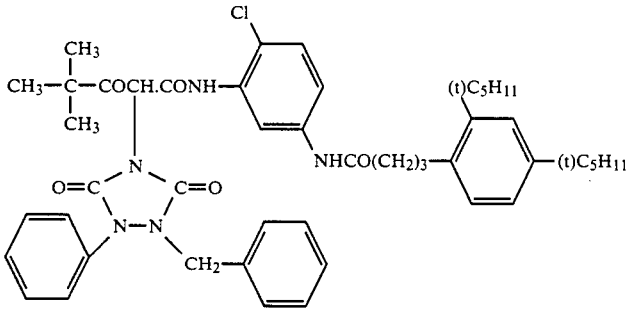

(3)

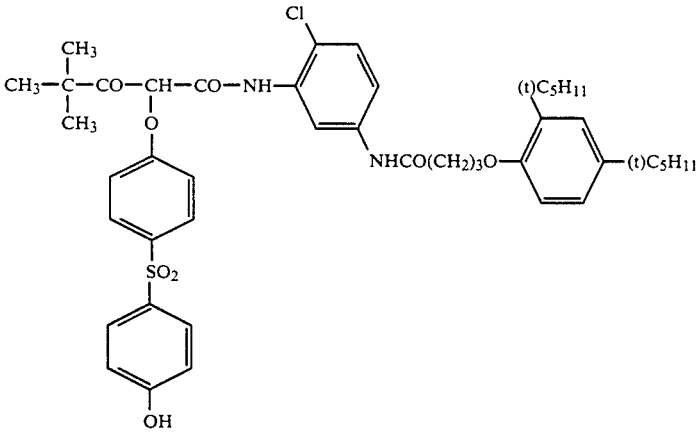

(4)

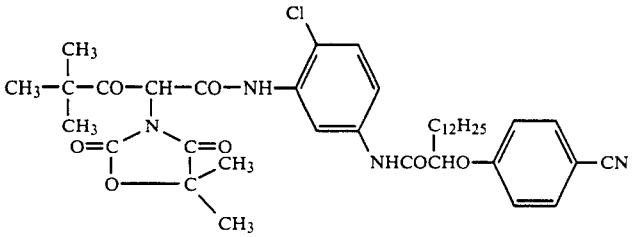

(5)

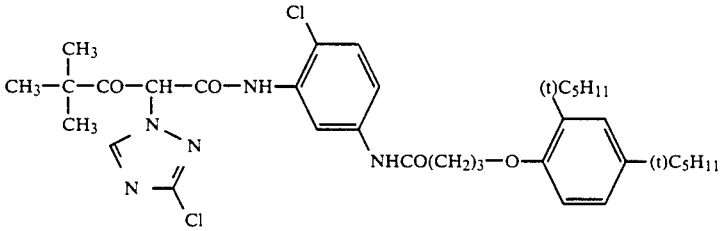

The amount of color couplers which may be used ranges from 0.001 to 1 mol per mol of photosensitive silver halide. Of this 0.01 to 0.5 mol of yellow coupler, 0.003 to 0.3 mol of magenta coupler, and of from 0.002 to 0.3 mol of photosensitive cyan coupler, per mol of photosensitive silver halide, is preferred.

In those cases in which a reflective support is used for the photosensitive material in which the color couplers represented by the aforementioned general formulae (IV), (V), (VI), (VII) or (VIII) are used, the preferred silver halide coated weight is from 1.5 to 0.1 g/m$^2$. In cases where a transparent support is used the preferred silver halide coated weight is from 7 to 0.2 g/m$^2$.

The couplers can be included in an emulsion layer by dispersion together with at least one type of high boiling point organic solvent. The use of those high boiling point solvents represented by general formulae (A) to (E) below is preferred.

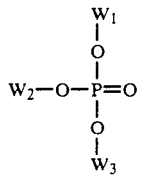

(A)

$W_1-COO-W_2$ (B)

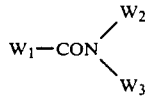

(C)

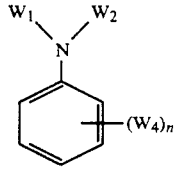

(D)

$W_1-O-W_2$ (E)

In the abaove formulae, $W_1$, $W_2$ and $W_3$ each represents substituted or unsubstituted alkyl group, cycloalkyl group, alkenyl group, aryl group or a heterocyclic group, $W_4$ represents a $W_1$ group, an —O—$W_1$ group or an —S—$W_1$ group, and n is an integer of from 1 to 5. When n is 2 or more, the $W_4$ groups may be the same or different. In general formula (E) the groups $W_1$ and $W_2$ may take the form of a condensed ring.

Polyalkyleneoxides, or ether, ester or amine derivatives thereof, thioether compounds, thiomorpholines, quaternary ammonium salt compounds, urethane derivatives, urea derivatives, imidazole derivatives and 3-pyrazolidone derivatives, can be included in photographic emulsions of this invention to raise contrast or for accelerating development.

Water soluble dyes such as oxonol dyes, hemioxonol dyes and merocyanine dyes can be used in the silver halide photographic emulsions of this invention as filter dyes, for anti-irradiation purposes, or for various other reasons. Furthermore, dyes such as cyanine dyes, merocyanine dyes and hemicyanine dyes, may be added as spectrally sensitizing dyes before, during, or after chemical sensitization.

Various surfactants can be included in the photographic emulsions of this invention for a variety of purposes. For example, they may be added as coating promotors, anti-static agents, slip agents, for emulsification and dispersion purposes, to prevent sticking or to improve photographic characteristics such as to accelerate development, harden contrast or increase photographic speed.

Furthermore, various additives such as anti-color fading agents, film hardening agents, anti-color fogging agents, ultraviolet absorbers and protective colloids such a gelatin, can be added to the photosensitive materials of this invention. Actual examples of these are described in *Research Disclosure* Vol. 176 (1978, XII), RD-17643.

The finished emulsions may be coated onto an appropriate support such as baryta paper, resin coated paper, synthetic paper, triacetate film, polyethyleneterephthalate film, vinyl chloride resin or other plastic base, or a glass plate.

The silver halide photographic materials of this invention can be used, for example, as color positive films, color papers, color negative films, color reversal films (both those which contain, and those which do not contain, couplers), photosensitive materials for cathode ray tube display purposes, photosensitive materials for X-ray recording purposes, photosensitive materials for silver salt diffusion transfer process purposes, photosensitive materials for color diffusion transfer process purposes, photosensitive materials for dye transfer process (imbibition transfer process) purposes, emulsions for use with a silver dye bleach processes, photosensitive materials on which a print-out image is recorded, direct print image type photosensitive materials, photosensitive materials for thermal development purposes, and photosensitive materials for physical development purposes.

The exposure for obtaining a photographic image can be carried out using normal methods. That is, any of the well known light sources may be used such as natural light (daylight), tungsten lamps, fluorescent lamps, mercury vapor lamps, xenon arc lamps, carbon arc lamps, xenon flash lamps, cathode ray tube flying spots etc. The exposure time may be for example, from 1/1000th of a second to 1 second, normal camera exposure times, and exposures shorter than 1/1000th of a second such as exposures ranging from $10^{-4}$ to $10^{-6}$ seconds using xenon flash tubes or cathode ray tubes, and exposures longer than 1 second. The spectral composition of the light used for the exposure can be adjusted, as required, using color filters. Laser light can also be used as exposing light. Furthermore, exposures can also be made using the light released from phosphors which have been excited by an electron beam such as X-rays, $\gamma$-rays or $\alpha$-rays.

All of the known methods and processing baths, as disclosed, for example, in *Research Disclosure* volume 176, pages 28–30 (RD-17643), can be used for the photographic processing of photosensitive materials of this invention. This may take the form of photographic processing in which a silver image is formed (black and white processing) or the form of photographic processing in which a dye image is formed (color photographic processing). A processing temperature between 18° and 50° C. is normally selected, but temperatures below 18° C. and above 50° C. can be used.

High temperature rapid processing at 30° C. or above is preferred.

In the interest of brevity and conciseness, the contents of the aforementioned numerous patents and articles are hereby incorporated by reference.

The following detailed Examples are presented as specific illustrations of the presently claimed invention. It should be understood, however, that the invention is not limited to the specific details set forth in the Examples.

EXAMPLE 1

A silver halide emulsion (A) was prepared in the way described below.

| | |
|---|---|
| Solution 1 | |
| Water | 1000 ml |
| Sodium chloride | 3.3 g |
| Gelatin | 32 g |
| Solution 2 | |
| Sulfuric acid (1N) | 24 ml |
| Solution 3 | |
| Compound A indicated below (1%) | 3 ml |

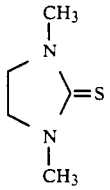

| | |
|---|---|
| Solution 4 | |
| Sodium chloride | 11.00 g |
| Water to make | 200 ml |
| Solution 5 | |
| Silver nitrate | 32.00 g |
| Water to make | 200 ml |
| Solution 6 | |
| Sodium chloride | 44.00 g |
| $K_2IrCl_6$ (0.001%) | 2.3 ml |
| Water to make | 560 ml |
| Solution 7 | |
| Silver nitrate | 128 g |
| Water to make | 560 ml |

Solution 1 was heated to 52° C. and Solutions 2 and 3 were added. Solutions 4 and 5 were then added simultaneously over a period of 14 minutes. After a further period of 10 minutes, Solutions 6 and 7 were added simultaneously over a period of 15 minutes. The temperature was reduced after a further period of 5 minutes and the emulsion was desalted.

Water and dispersed gelatin were added, the pH was adjusted to 6.2 and a monodisperse cubic silver chloride emulsion of average grain size 0.48 μm and having variation coefficient (the value obtained by dividing the standard deviation by the average grains size, s/d) 0.10, was obtained. Sodium thiosulfate was added to this emulsion at 58° C. and chemical sensitization was carried out in such a way as to provide a surface latent image type emulsion. Then, the compound CR-24 described earlier was added at a rate of $4\times10^{-4}$ mol per mol of silver halide and the emulsion was spectrally sensitized. Compound (XXI)-(7) was added at the rate of $5\times10^{-4}$ mol per mol of silver halide as a stabilizer.

Emulsion (B) was prepared in the same way as for emulsion (A) except that Solution 8 described below was added after the addition of Solutions 6 and 7, and the temperature was reduced 5 minutes after this addition.

| | |
|---|---|
| Solution 8 | |
| Potassium bromide | 5.60 g |
| Water to make | 280 ml |

Emulsion (C) was prepared in the same way as emulsion (A) except that Solutions 9 and 10 described below were added over a period of 15 minutes instead of Solutions 6 and 7, respectively. Then, after a period of 10 minutes, Solutions 11 and 12 were added over a period of 5 minutes, and the temperature was reduced 5 minutes after this addition.

| | |
|---|---|
| Solution 9 | |
| Sodium chloride | 41.28 g |
| $K_2IrCl_6$ (0.001%) | 2.3 ml |
| Water to make | 525 ml |
| Solution 10 | |
| Silver nitrate | 120.00 g |
| Water to make | 525 ml |
| Solution 11 | |
| Potassium bromide | 5.60 g |
| Water to make | 100 ml |
| Solution 12 | |
| Silver nitrate | 8.00 g |
| Water to make | 100 ml |

Emulsion (D) was then prepared in the same way as for emulsion (C) but using Solutions 13 and 14 in place of Solutions 11 and 12 used for emulsion (C).

| | |
|---|---|
| Solution 13 | |
| Potassium bromide | 4.48 g |
| Sodium chloride | 0.55 g |
| Water to make | 100 ml |
| Solution 14 | |
| Silver nitrate | 8.00 g |
| Water to make | 100 ml |

Next, emulsion (E) was prepared in the same way as for emulsion (A) except that a very fine grained silver bromide emulsion (grain size 0.05 μm) was added in an amount such that the silver bromide content was 1 mol % with respect to the silver chloride prior to the aforementioned chemical sensitization, and the mixture was physically ripened for 10 minutes at 58° C.

Emulsion (F) was prepared in the same way as foremulsion (E) except that CR-24 in an amount of $4.0\times10^{-4}$ mol per mol of silver halide was added before the addition of the very fine grained silver bromide emulsion.

Next, emulsion (G) was prepared in the same way as for emulsion (E) except that a bromine or bromide ion slow release agent S-3, in an amount containing 1 mol % of silver bromide with respect to the silver chloride was added instead of the very fine grained silver bromide emulsion.

Emulsion (H) was prepared in the same way as for emulsion (G) except that CR-24 in an amount of $4.0\times10^{-4}$ mol per mol of silver halide was added before the addition of the bromine or bromide ion slow release agent.

Next, 100 grams of a magenta coupler, coupler M-(1) was dissolved along with 80 grams of colored image stabilizer, Cpd-3, and 38 grams of Cpd-4 in the mixture of 130 ml of the solvent, Solv-2 and 100 ml of ethyl acetate. The solution was emulsified and dispersed in 1200 grams of 10% aqueous gelatin solution which contained 4.0 grams of sodium dodecylbenzenesulfonate, to provide emulsified dispersion (A). The chemical structures of the compounds used are indicated below.

(Cpd-3) Colored Image Stabilizer

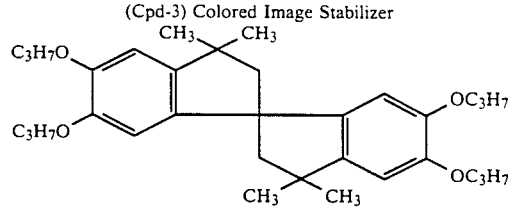

-continued (Cpd-4) Colored Image Stabilizer

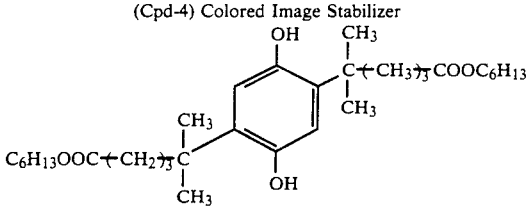

(Solv-2) Solvent
A 1:1 mixture (by volume) of:

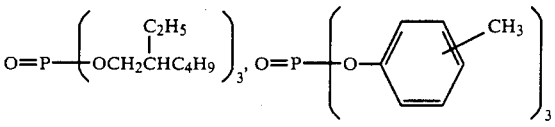

TABLE 1

| Sample No. | Support | Green Sensitive Emulsion Layer: Emulsion (Coated Ag · Wt. 400 mg/m²) | Emulsified Dispersion | Protective Layer | Remarks |
|---|---|---|---|---|---|
| 101 | *1 | (A) | *2 | *3 | Comparative Example |
| 102 | " | (B) | " | " | Comparative Example |
| 103 | " | (C) | " | " | Comparative Example |
| 104 | " | (D) | " | " | Comparative Example |
| 105 | " | (E) | " | " | Comparative Example |
| 106 | " | (F) | " | " | Comparative Example |
| 107 | " | (G) | " | " | This Invention |
| 108 | " | (H) | " | " | This Invention |

*1: A paper support laminated with polyethylene on both sides.
*2: Emulsified Dispersion A
Magenta Coupler (ExM1) 350 mg/m²
Anti-color Fading Agent; (Cpd-3) 280 mg/m², (Cpd-4) 133 mg/m²
Coupler Solvent (Solv-2) 0.455 ml/m²
Gelatin was added to the coating liquid to provide a gelatin coated weight of 1500 mg/m²
*3: Gelatin coated weight 1500 mg/m²

Eight samples were prepared as shown in Table 1. The polyethylene on the side on which the emulsion layer and the protective layer were coated contained titanium dioxide and a trace of ultramarine. Moreover, 1-oxy-3,5-dichloro-s-triazine sodium salt was used as a film hardening agent in each layer.

The following tests were carried out in order to investigate the photographic characteristics of the coated samples.

First, the coated samples were subjected to a graded exposure for sensitometric purposes through a green filter, using a light source of color temperature 3200° K. in a sensitometer (FWH model, made by the Fuji Photographic Film Co.). The exposure at this time was of 250 CMS with an exposure time of 1/10th of a second.

Subsequently, the samples were color developed and processed in the way indicated below.

| Processing Step | Temperature | Time |
|---|---|---|
| Color Development | 35° C. | 45 seconds |
| Bleach-fix | 35° C. | 45 seconds |
| Water wash | 28–35° C. | 90 seconds |

| Color Development Bath | |
|---|---|
| Triethanolamine | 8.12 g |
| N,N-Diethylhydroxylamine | 4.93 |
| Fluorescent whitener ("Uvitex CK", made by Chiba Geigy) | 2.80 g |
| 4-Amino-3-methyl-N-ethyl-N-[β-(methanesulfonamido)ethyl]-p-phenylenediamine sulfate | 4.96 g |
| Sodium sulfite | 0.13 g |
| Potassium carbonate | 18.40 g |
| Potassium bicarbonate | 4.85 g |

-continued

| | |
|---|---|
| EDTA.2Na.2H₂O | 2.20 g |
| Sodium chloride | 1.36 g |
| Water to make | 1000 ml |
| pH | 10.05 |
| Bleach-Fix Bath | |
| Ammonium thiosulfate (54 wt %) | 103.0 ml |
| NH₄[EDTA.Fe] | 54.10 g |
| EDTA.2Na.2H₂O | 3.41 g |
| Sodium sulfite | 16.71 g |
| Glacial acetic acid | 8.61 g |
| Water to make | 1000 ml |
| pH | 5.44 |

The color density of each processed sample was measured and the speed and gradation was obtained in each case. The speed was determined as the reciprocal of the exposure required to provide a color density 0.5 above the fog density, and the results are shown as relative values, taking the speed of Sample 101 to be 100. Furthermore, the gradation is shown as the difference between the logarithm of the exposure required to provide a color density of 0.5 and the logarithm of the exposure required to provide a color density of 2.0.

The results obtained are summarized in Table 2.

It is clear from Table 2 that emulsion (107) which contained grains which had been subjected to halogen conversion using a slow release agent had a higher speed and contrast than those emulsions (i.e., 102, 103, and 104) in which halogen conversion had been carried out using a water soluble bromide, and emulsion 105 which had been recrystallized with very fine grained silver bromide. In those cases where an adsorbing compound was added prior to halogen conversion or recrystallization the method of adding a slow release agent (i.e., Sample 108) clearly gave an emulsion that had a higher speed and a higher contrast than Sample 106 obtained using the method involving the addition of a very fine grained silver bromide.

TABLE 2

| Sample No. | Speed | Gradation | Remarks |
|---|---|---|---|
| 101 | 100 | 0.56 | Comparative Example |
| 102 | 235 | 1.55 | Comparative Example |
| 103 | 342 | 1.32 | Comparative Example |
| 104 | 331 | 1.28 | Comparative Example |
| 105 | 370 | 1.11 | Comparative Example |
| 106 | 398 | 0.57 | Comparative Example |
| 107 | 403 | 1.08 | This Invention |
| 108 | 431 | 0.56 | This Invention |

EXAMPLE 2

A multi layer color printing paper having the layer structure indicated below was prepared on a paper support which had been laminated on both sides with polyethylene.

The coating liquids were prepared by mixing together the emulsion, the various reagents and an emulsified dispersion of the coupler and forming a solution. The method of preparation is also described below.

Preparation of the Coupler Emulsified Dispersion

Ethyl acetate (27.2 cc) and 7.7 cc of the solvent (Solv-1) were added to 19.1 grams of the yellow coupler (ExY) and 4.4 grams of the colored image stabilizer (Cpd-1), to form a solution which was emulsified and dispersed in 185 cc of a 10% aqueous gelatin solution which contained 8 cc of 10% sodium dodecylbenzenesulfonate.

The emulsions used for the magenta, cyan and intermediate layers were then prepared in the same way.

The compounds used in these emulsions are set forth below.

Yellow Coupler (ExY-1)

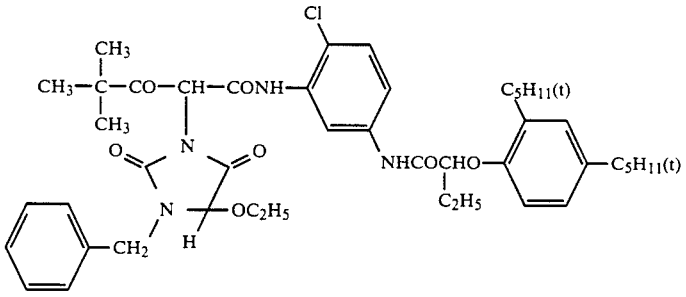

Magenta Couplers

Same as the aforementioned M-(1) (ExM-1)

Same as the aforementioned M-(3) (ExM-2)

(ExM3)

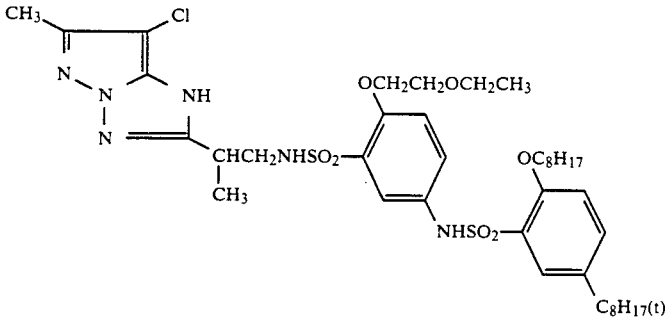

(ExM4)

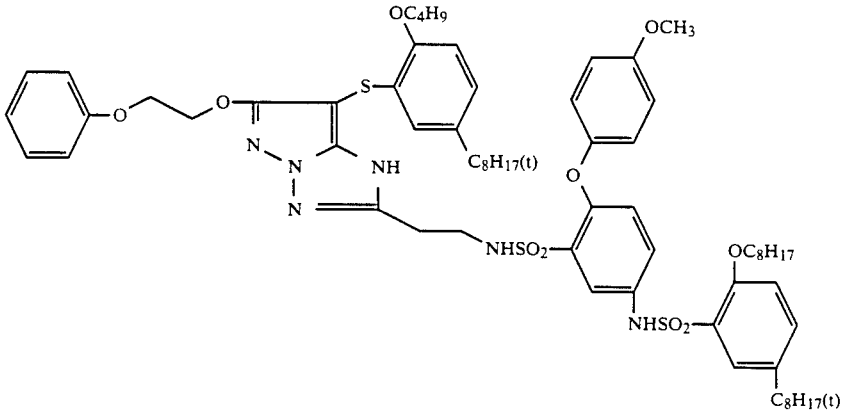

Same as the aforementioned C-(1). (ExCl)

-continued
(ExC2)
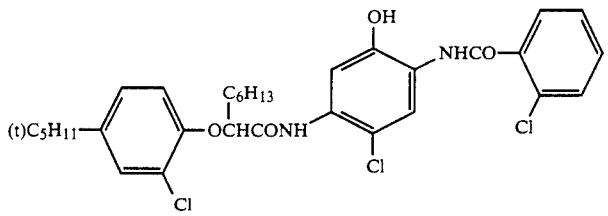
(ExC3)
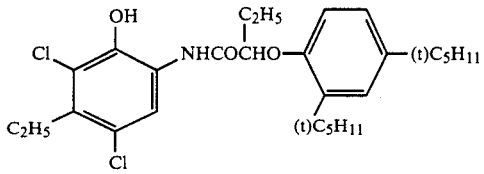
(ExC4)
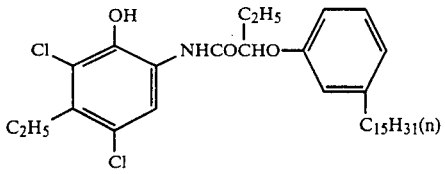
(ExC5)
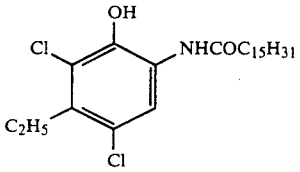
Colored Image Stabilizer (Cpd-1)
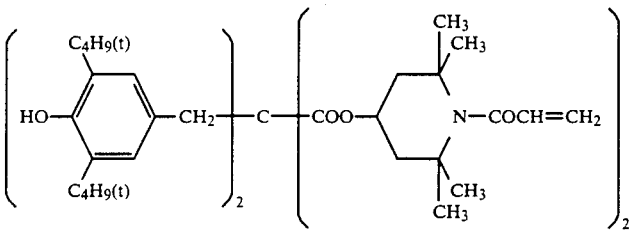
Color Mixing Preventing Agent (Cpd-2)
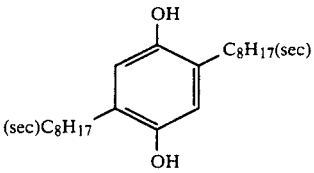
Color Mixing Preventing Agent (Cpd-5)
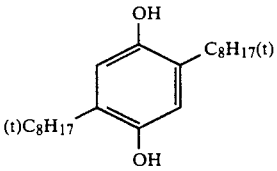
Colored Image Stabilizer (Cpd-6)
A 5:8:9 mixture (by weight) of:

-continued
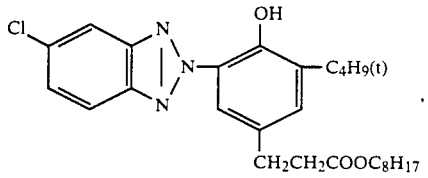
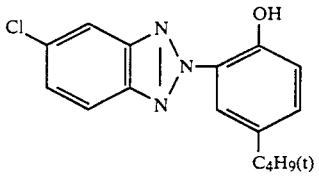
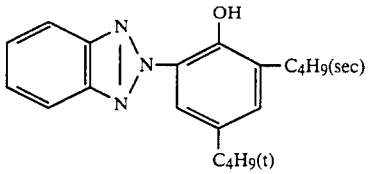
Polymer (Cpd-7)
$\text{-}(CH_2-CH)_n\text{-}$
$\quad\quad |$
$\quad\quad CONHC_4H_9(t)$
Average Molecular weight: 80,000
Ultraviolet Absorber (UV-1)
A 2:9:8 mixture (by weight) of:
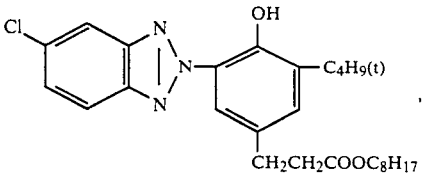
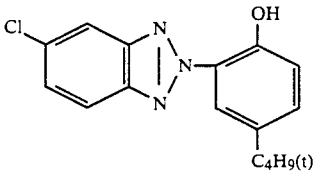
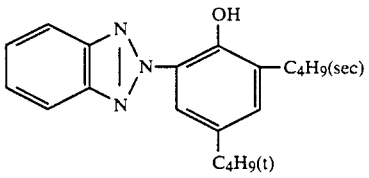
Solvent (Solv-1)
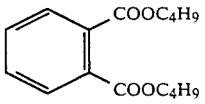
Solvent (Solv-3)
$O{=}P(O-C_9H_{19}(iso))_3$ Solvent -continued (Solv-4)

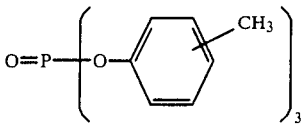

A stabilizer (the aforementioned compound (XXI)-(7)) was added to the blue sensitive emulsion layer at a rate of $2.5\times10^{-4}$ mol per mol of silver halide.

Moreover, 1-oxy-3,5-dichloro-3-triazine, sodium salt, was used as a gelatin hardening agent in each layer.

The dyes indicated below were added to the emulsion layer as anti-irradiation dyes.

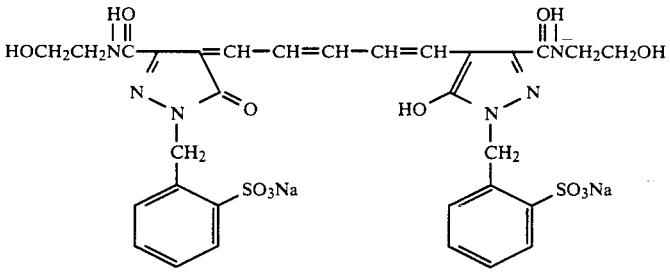

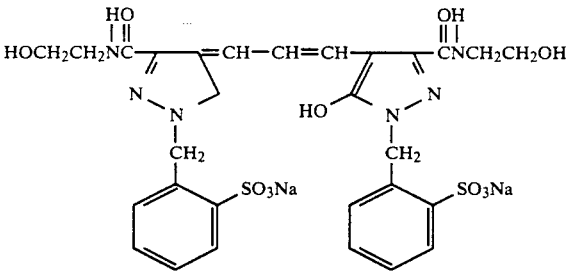

The compound indicated below was added at a rate of $2.6\times10^{-3}$ mol per mol of silver halide to the red sensitive emulsion layer.

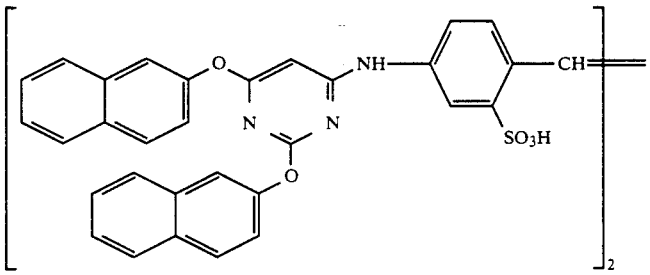

The method used to prepare the emulsions used in this example is described below.

Emulsion (J) prepared in the way described below was used in the blue sensitive emulsion layer as an emulsion of this invention.

Preparation of Emulsion (J)

Formation of the Silver Halide Host Grains

| Solution 1 | |
|---|---|
| Water | 1000 cc |
| Sodium chloride | 5.5 g |
| Gelatin | 32 g |
| Solution 2 | |
| Sulfuric acid (1N) | 24 cc |
| Solution 3 | |
| Compound A indicated below (1%) | 3 cc |

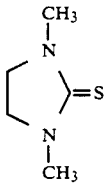

| Solution 4 | |
|---|---|
| Sodium chloride | 1.7 g |
| Water to make | 200 cc |
| Solution 5 | |
| Silver nitrate | 5 g |

-continued

| | |
|---|---|
| Water to make | 200 cc |
| Solution 6 | |
| Sodium chloride | 41.3 g |
| $K_2IrCl_6$ (0.001%) | 0.5 cc |
| Water to make | 600 cc |
| Solution 7 | |
| Silver nitrate | 120 g |
| Water to make | 600 cc |

Solution 1 was heated to 76° C. and Solutions 2 and 3 were added.

Solutions 4 and 5 were then added simultaneously over a period of 10 minutes.

After a further period of 10 minutes, Solutions 6 and 7 were added simultaneously over a period of 35 minutes. The temperature was reduced after a further period of 5 minutes and the emulsion was desalted. Water and dispersed gelatin were added, the pH was adjusted to 6.3, and a monodisperse cubic silver chloride emulsion of average grain size of 1.2 μm and having a variation coefficient (the value obtained by dividing the standard deviation by the average grain size, s/d) of 0.10, was obtained.

One third of this emulsion was taken, 8.4 cc of a 0.6% solution of blue spectral sensitizing dye (the aforementioned dye CR-7) was added as an adsorbing compound, and the bromine or bromide ion slow release agent (I-3) was added at a rate of 0.5 mol % with respect to the silver chloride emulsion. The mixture was then ripened for 10 minutes at 58° C. Sodium thiosulfate was added, chemical sensitization was carried out to provide a surface latent image type emulsion and the aforementioned stabilizer ((XXI)-(7)) was added at a rate of $10^{-4}$ mol per mol of silver. This was emulsion (J). Half of the remaining emulsion to which no adsorbing compound had been added was taken, the same amount of the bromine or bromide ion slow release agent mentioned above was added, and the mixture was physically ripened for 10 minutes. Thereafter sodium thiosulfate was added at 58° C. and optimal chemical sensitization was carried out in the same way as before, and the emulsion obtained on adding CR 7 at a rate of $2.6\times10^{-4}$ mol per mol of silver after completion of chemical sensitization, was taken as emulsion (K).

The remainder of the emulsion was used to prepare emulsion (N) which was prepared in the same way as for emulsion (K) except that 0.5 mol % with respect to the silver chloride, of a very fine grained silver bromide emulsion (grain size 0.05 μm) was added instead of the bromine or bromide ion slow release agent. Emulsions (E), (G), and (H) prepared in Example 1 were used as green sensitive emulsions.

Red sensitive emulsions were prepared in the same way as for the green sensitive emulsions (E), (G) and (H) except that the sensitizing dye used as an adsorbing compound was changed to CR-32, and the amount added was set at $1.5\times10^{-4}$ mol per mol of silver halide, and these were emulsions (O), (L) and (M).

These emulsions were coated in the combinations indicated in Table 3 to provide Sample 200 to 208.

The couplers were substituted on an equimolar basis in all cases.

TABLE 3

| Sample No. | First Layer Emulsion | First Layer Coupler | Third Layer* Emulsion | Third Layer* Coupler | Fifth Layer Emulsion | Fifth Layer Coupler |
|---|---|---|---|---|---|---|
| 200 | (N) | ExY | (E) | ExM1 | (O) | A 1:1 blend of ExC1 and ExC2 |
| 201 | (K) | ExY | (G) | ExM1 | (L) | A 1:1 blend of ExC1 and ExC2 |
| 202 | (J) | ExY | (H) | ExM1 | (M) | A 1:1 blend of ExC1 and ExC2 |
| 203 | (J) | ExY | (H) | ExM2 | (M) | ExC4 |
| 204 | (J) | ExY | (H) | ExM3 | (M) | ExC4 |
| 205 | (J) | ExY | (H) | ExM4 | (M) | ExC4 |
| 206 | (J) | ExY | (H) | ExM3 | (M) | ExC3 |
| 207 | (J) | ExY | (H) | ExM3 | (M) | ExC5 |
| 208 | (J) | ExY | (H) | ExM3 | (M) | ExC1 |

*In cases where the third layer coupler was not ExM1, the silver halide emulsion coated weight of the third layer was adjusted to 0.18 g/m².

Layer Structure

The composition of each layer in Sample 200 was as indicated below. The numerical values indicate the coated weights (g/m²), and in the case of the silver halide emulsions, the coated weights are shown after calculation as silver.

Support

Polyethylene laminated paper having white pigment ($TiO_2$) and blue dye (ultramarine) included in the polyethylene on the first layer side

| | |
|---|---|
| First Layer: Blue sensitive layer | |
| Silver halide emulsion | 0.30 |
| Gelatin | 1.86 |
| Yellow coupler (ExY) | 0.82 |
| Colored image stabilizer (Cpd-1) | 0.19 |
| Solvent (Solv-1) | 0.35 |
| Second Layer: Color mixing preventing layer | |
| Gelatin | 0.99 |
| Color mixing preventing agent (Cpd-2) | 0.08 |
| Third Layer: Green sensitive layer | |
| Silver halide emulsion | 0.36 |
| Gelatin | 1.24 |
| Magenta coupler (ExM1) | 0.31 |
| Colored image stabilizer (Cpd-3) | 0.25 |
| Colored image stabilizer (Cpd-4) | 0.12 |
| Solvent (Solv-2) | 0.42 |
| Fourth Layer: Ultraviolet absorbing layer | |
| Gelatin | 1.58 |
| Ultraviolet absorber (UV-1) | 0.62 |
| Color mixing preventing agent (Cpd-5) | 0.05 |
| Solvent (Solv-3) | 0.24 |
| Fifth Layer: Red sensitive layer | |
| Silver halide emulsion | 0.23 |
| Gelatin | 1.34 |
| Cyan coupler (a 1:1 blend of ExC1 and ExC2) | 0.34 |
| Colored image stabilizer (Cpd-6) | 0.17 |
| Polymer (Cpd-7) | 0.40 |
| Solvent (Solv-4) | 0.23 |
| Sixth Layer: Ultraviolet absorbing layer | |
| Gelatin | 0.53 |
| Ultraviolet absorber (UV-1) | 0.21 |
| Solvent (Solv-3) | 0.08 |
| Seventh Layer: Protective layer | |
| Gelatin | 1.33 |
| Poly(vinyl alcohol) acrylic modified copolymer (17% modification) | 0.17 |
| Liquid paraffin | 0.03 |

The coated samples 200 to 208 which were obtained were color developed and processed using the processing baths and processing operations described in Example 1. The speeds of the blue sensitive, green sensitive and red sensitive layers were compared. The results obtained are shown in Table 4.

It is clear from these results that the combinations of this invention give higher speeds than the comparative examples.

TABLE 4

| Sample | Red Sens. Layer | Green Sens. Layer | Blue Sens. Layer | Remarks |
|---|---|---|---|---|
| 200 | 100 | 100 | 100 | Comparative Ex. |
| 201 | 111 | 107 | 107 | This Invention |
| 202 | 123 | 119 | 119 | This Invention |
| 203 | 122 | 123 | 131 | This Invention |
| 204 | 121 | 120 | 130 | This Invention |
| 205 | 122 | 122 | 120 | This Invention |
| 206 | 121 | 120 | 112 | This Invention |
| 207 | 123 | 121 | 131 | This Invention |
| 208 | 123 | 120 | 119 | This Invention |

EXAMPLE 3

A comparison of the speeds of the blue, green and red sensitive layers in Example 2 was made after changing the processing baths and processing operations in the way indicated below. The results obtained were more or less the same as those described in Example 2.

| Processing Operation | Temperature | Time |
|---|---|---|
| Color Development | 35° C. | 45 seconds |
| Bleach-fix | 30–35° C. | 45 seconds |
| Rinse (1) | 30–35° C. | 20 seconds |
| Rinse (2) | 30–35° C. | 20 seconds |
| Rinse (3) | 30–35° C. | 20 seconds |
| Rinse (4) | 30–35° C. | 30 seconds |
| Drying | 70–80° C. | 60 seconds |

A four-tank countercurrent system from rinse (4) to rinse (1) was used.

| | |
|---|---|
| Color Development Bath | |
| Water | 800 ml |
| Ethylenediamine-N,N,N',N'-tetramethylene phosphonic acid | 1.5 g |
| Sodium chloride | 1.4 g |
| Potassium carbonate | 25 g |
| N-Ethyl-N-(β-methanesulfonylaminoethyl)-3-methyl-4-aminoaniline sulfate | 5.0 g |
| N,N-Bis(carboxymethyl)hydrazine | 5.0 g |
| Fluorescent whitener ('Uvitex CK', made by Ciba Geigy) | 2.0 g |
| Water to make | 1000 ml |
| pH (25° C.) | 10.10 |
| Bleach-Fix Bath | |
| Water | 400 ml |
| Ammonium thiosulfate (70%) | 100 ml |
| Sodium sulfite | 18 g |
| Ammonium (ethylenediaminetetra-acetato)ferrate (III) | 55 g |
| Disodium ethylenediaminetetraacetate- | 3 g |
| Ammonium bromide | 40 g |
| Glacial acetic acid | 8 g |
| Water to make | 1000 ml |
| pH (25° C.) | 5.5 |

Rinse Bath

Ion exchanged water (Calcium and magnesium both less than 3 ppm)

Thus, silver halide photographic emulsions which have both a higher speed in the, intrinsic speed region and increased stability are obtained by means of this invention.

The fog level is also low and the stability is excellent even when high temperature rapid processing is carried out.

Moreover, there is a further advantage in that high contrast emulsions are obtained and the pressure characteristics are excellent so that there is little pressure desensitization and little fogging in unexposed parts due to pressure.

While the invention has been described in detail with reference to specific preferred embodiments thereof, it will be apparent to one skilled in the art that various changes and modifications can be made therein without departing from the spirit and scope of the invention.

What is claimed is:

1. A silver halide photographic material containing a support having thereon a light-sensitive layer comprising at least a substantially silver iodide free monodisperse silver chlorobromide emulsion having a variation coefficient of not more than 0.25 obtained by:

(i) forming chlorine containing silver halide grains by reacting at least one water-soluble salt and at least one water-soluble halide, wherein one of said at least one water-soluble halide or a water-soluble chloride;

(ii) adding a bromine atom or bromide ion slow release agent to the silver halide grains formed in step (i);

(iii) conducting halogen conversion; followed by (iv) sulfur sensitization, said release agent being represented by formula (S):

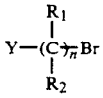

(S)

wherein Y represents a group having a Hammett $\sigma_p$ value greater than O, $R_1$ and $R_2$, which may be identical or different, are selected from hydrogen, alkyl groups, alkenyl groups, aralkyl groups, aryl groups, or those groups represented by Y, Y and $R_1$ may undergo ring closure to form a heterocyclic ring, and n is an integer of from 1 to 3.

2. A silver halide photographic material according to claim 1, said slow release agent having been added in an amount ranging from about 0.1 mol % to about 5 mol %, based on the total silver halide content of the monodisperse silver chlorobromide emulsion thus obtained.

3. A silver halide photographic material according to claim 2, said agent being added in an amount ranging from about 0.2 to about 3 mol %.

4. A silver halide photographic material according to claim 1, wherein Y and $R_1$ form a heterocyclic ring.

5. A silver halide photographic material according to claim 2, wherein said chlorobromide emulsion is obtained by adsorbing at least one compound onto the silver halide grains to control the initiation point for halogen conversion, before the addition of the slow release agent.

6. A silver halide photographic material according to claim 5, wherein the emulsion contains at least 95 mol % silver chloride.

7. A silver halide photographic material according to claim 6, wherein the silver halide grains have an average grain size ranging from about 0.2 to about 2 μm and a monodisperse grain size distribution.

8. A silver halide photographic material according to claim 5, wherein the compounds used to control the initiation point for halogen conversion are adsorbed on the (100) planes of the silver halide grains.

9. A silver halide photographic material according to claim 5, wherein a compound used to control the initiation point for halogen conversion is selected from those represented by formula (I):

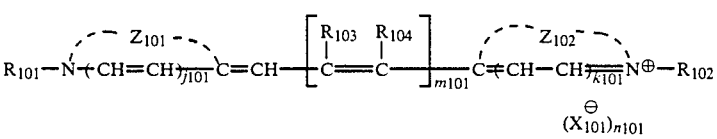

(I)

wherein $Z_{101}$ and $Z_{102}$, which may be identical or different, are selected from atoms suitable for forming a heterocyclic nucleus; $R_{101}$ and $R_{102}$, which may be identical different, are selected from alkyl groups, alkenyl groups, alkynyl groups or aralkyl groups; $m_{101}$ is 0,1,2, or 3 with the proviso that when $m_{101}$ is 1, $R_{103}$ is a hydrogen atom, a lower alkyl group, an aralkyl group or an aryl group, when $m_{101}$ is 2 or 3 $R_{103}$ is a hydrogen atom, or a group joined with other $R_{103}$ groups to form a heterocyclic ring; $R_{104}$ is a group selected from hydrogen, a lower alkyl group, an aralkyl group, or a group joined to a $R_{102}$ group to form a 5- or 6-membered ring, with the proviso that when $m_{101}$ is 1, $R_{104}$ is hydrogen; $j_{101}$ is 0 or 1; $k_{101}$ is 0 or 1; $X^{\ominus}_{101}$ is an acid anion; and $n_{101}$ is 0 or 1.

10. A silver halide photographic material according to claim 5, wherein a compound used to control the initiation point for halogen conversion is selected from those represented by formula (II):

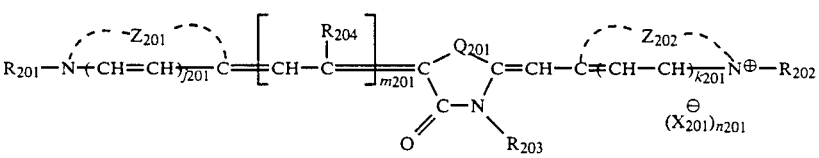

(II)

wherein $Z_{201}$ and $Z_{202}$, which may be identical or different, are selected from atoms suitable for forming a heterocyclic nucleus; $R_{201}$ and $R_{202}$, which may be identical or different, are selected from alkyl groups, alkenyl groups, alkynyl groups, or aralkyl groups; $R_{203}$ is selected from alkyl groups, alkenyl groups, alkynyl groups, or aryl groups; $m_{201}$ is 0, 1 or 2; $R_{204}$ is selected from hydrogen, lower alkyl groups or aryl groups; $Q_{201}$ represents a sulfur atom, an oxygen atom, a selenium atom, or an $>N—R_{205}$ group wherein $R_{205}$ is an alkyl group, alkenyl group, alkynyl group, or aryl group; $j_{201}$ is 0 or 1; $k_{201}$ is 0 or 1; $X^{\ominus}_{201}$ is an acid anion; and $n_{201}$ is 0 or 1.

11. A silver halide photographic material according to claim 5, wherein a compound used to control the initiation point for halogen conversion is selected from those represented by formula (III):

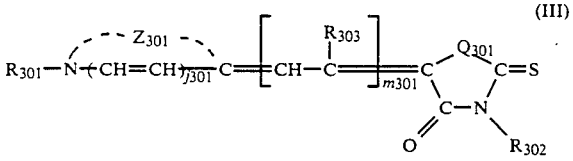

(III)

wherein $Z_{301}$ is a group of atoms suitable for forming a heterocyclic ring; $Q_{301}$ represents a sulfur atom, an oxygen atom, a selenium atom, or an $>N—R_{205}$ group wherein $R_{205}$ is an alkyl group, alkenyl group, alkynyl group, or aryl group; $R_{301}$ is selected from alkyl groups, alkenyl groups, alkynyl groups or aralkyl groups; $R_{302}$ is selected from alkyl groups, alkynyl groups, alkenyl groups, or aryl groups; $m_{301}$ is 0, 1 or 2; $R_{303}$ is selected from hydrogen, a lower alkyl group, or aryl groups; and $j_{301}$ is 0 or 1.

12. A silver halide photographic material according to claim 1, wherein Y in formula (S) is a halogen atom, a trifluoromethyl group, a cyano group, a formyl group, a carboxylic acid group, a sulfonic acid group, a carbamoyl group, an acyl group, an oxycarbonyl group, a sulfonyl group, a sulfonyloxy group, a carbonyloxy group, a sulfamoyl group or a heterocyclic group.

13. A silver halide photographic material according to claim 4, wherein the heterocyclic ring is an imidazolyl, pyridyl, thienyl, quinolyl or tetrazolyl ring.

14. A silver halide photographic material according to claim 1, wherein, in formula (S), Y is a cyano group, a carboxylic acid group, carbamoyl group, an acyl group, a sulfonyl group, an oxycarbonyl group, a sulfamoyl group or a heterocyclic group, $R_1$ and $R_2$ are hydrogen atom or selected from those groups represented by Y, and n is an integer of value 1 or 2.

15. A silver halide photographic material according to claim 1, wherein, prior to the addition of the slow release agent, the silver halide grains are cubic.

16. A silver halide photographic material according to claim 1, wherein prior to the addition of the slow release agent, the silver halide grains are tetradecahedral crystalline grains.

17. A silver halide photographic material according to claim 1, wherein the silver halide grains have a composition comprising silver chlorobromide or silver chloride which contains less than 2 mol % of silver iodide.

18. A silver halide photographic material according to claim 1, wherein the halide composition is that of a silver chlorobromide or silver chloride which contains no silver iodide.

19. A silver halide photographic material according to claim 1, wherein the variation coefficient with respect to the grains size of the silver halide grains is not more than 0.20.

20. A silver halide photographic material according to claim 1, wherein the variation coefficient with respect to the grains size of the silver halide grains is not more than 0.15.

21. A silver halide photographic material according to claim 5, wherein the variation coefficient with respect to the grains size of the silver halide grains is not more than 0.10.

22. A silver halide photographic material according to claim 5, wherein a compound used to control the initiation point for halogen conversion is a mercaptoazole selected from those represented by formula (XXI), (XXII), and (XXIII):

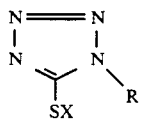

(XXI)

wherein R represents an alkyl group, an alkenyl group or an aryl group, and X represents a hydrogen atom, an alkali metal atom, an ammonium group or a precursor thereof;

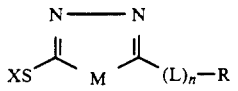

(XXII)

wherein M represents a sulfur atom or an oxygen atom, L represents a divalent linking group and R represents a hydrogen atom, an alkyl group, an alkenyl group or an aryl group;

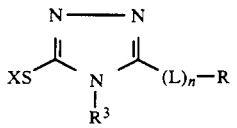

(XXIII)

wherein R and X have the same significance as those in formula (XXI), and L has the same significance as that in formula (XXII), $R^3$ has the same significance as R, and the R and $R^3$ may be the same or different.

23. A silver halide photographic material according to claim 5, wherein a compound used to control the initiation point for halogen conversion is a nucleic acid or a nucleic acid degradation product.

24. A silver halide photographic material according to claim 5, wherein the amount of the compound is from $10^{-6}$ to $10^{-2}$ mol per mol of silver halide.

25. A silver halide photographic material according to claim 5, wherein the amount of the compound is from $10^{-5}$ to $10^{-3}$ mol per mol of silver halide.

26. A silver halide photographic material according to claim 1, wherein the halogen conversion is carried out while suitably controlling the temperature within the range of from 30° to 80° C. and the silver ion concentration within the range from pAg 5 to pAg 10.

* * * * *